US007751729B2

(12) United States Patent
Watanabe et al.

(10) Patent No.: US 7,751,729 B2
(45) Date of Patent: Jul. 6, 2010

(54) IMAGE FORMING APPARATUS AND APPARATUS FOR RECEIVING CONSUMABLE SUPPLYING MEMBER

(75) Inventors: Toshihiko Watanabe, Osaka (JP); Tasuku Chihara, Osaka (JP)

(73) Assignee: Kyocera Mita Corporation (JP)

( * ) Notice: Subject to any disclaimer, the term of this patent is extended or adjusted under 35 U.S.C. 154(b) by 236 days.

(21) Appl. No.: 11/969,252

(22) Filed: Jan. 4, 2008

(65) Prior Publication Data

US 2008/0166145 A1 Jul. 10, 2008

(30) Foreign Application Priority Data

| | | |
|---|---|---|
| Jan. 10, 2007 | (JP) | 2007-002457 |
| Jan. 10, 2007 | (JP) | 2007-002458 |
| Jan. 10, 2007 | (JP) | 2007-002459 |
| Jan. 10, 2007 | (JP) | 2007-002460 |
| Jan. 10, 2007 | (JP) | 2007-002462 |

(51) Int. Cl.
*G03G 15/08* (2006.01)

(52) U.S. Cl. ..... 399/27; 399/23; 399/107

(58) Field of Classification Search ..... 399/13, 399/27, 107, 391, 393, 23, 24
See application file for complete search history.

(56) References Cited

U.S. PATENT DOCUMENTS

| | | | | |
|---|---|---|---|---|
| 4,657,372 | A * | 4/1987 | Ikeda et al. | 399/13 |
| 5,692,231 | A * | 11/1997 | O et al. | 399/23 |
| 2006/0008292 | A1 | 1/2006 | Watanabe | |

FOREIGN PATENT DOCUMENTS

| | | |
|---|---|---|
| JP | 2003-158383 | 5/2003 |
| JP | 2006-23347 | 1/2006 |

* cited by examiner

*Primary Examiner*—Hoang Ngo
(74) *Attorney, Agent, or Firm*—Gerald E. Hespos; Michael J. Porco

(57) ABSTRACT

An image forming apparatus is provided with an apparatus main body having a casing structure and adapted to perform an image forming operation, a window provided on a casing of the apparatus main body for enabling the interior of the apparatus main body to be seen, and an indicator provided in the apparatus main body for displaying specified indication information. The indicator is arranged at such a position as to face the window.

27 Claims, 15 Drawing Sheets

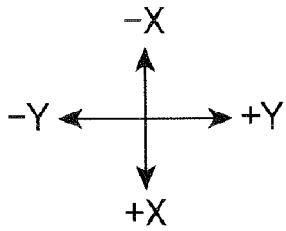
FIG.6A FIG.6B FIG.6C FIG.6D FIG.6E
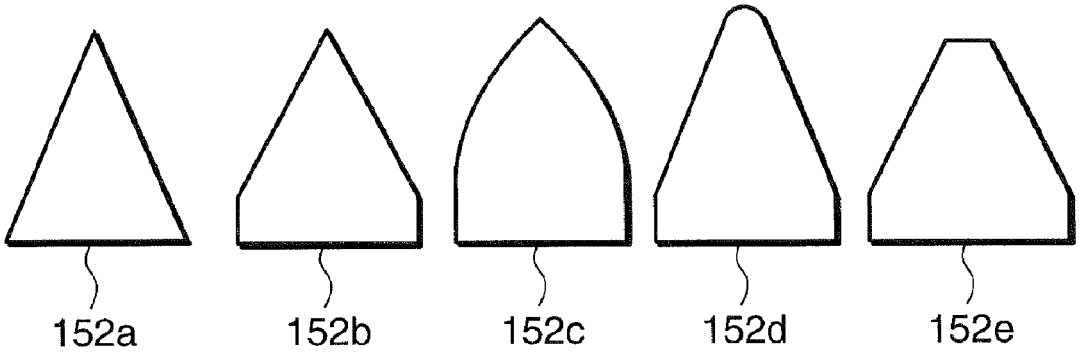

IMAGE FORMING APPARATUS AND APPARATUS FOR RECEIVING CONSUMABLE SUPPLYING MEMBER

BACKGROUND OF THE INVENTION

1. Field of the Invention

The present invention relates to an image forming apparatus such as a printer, a copier, a facsimile machine or a complex machine having functions of these apparatuses, and an apparatus for receiving a consumable supplying member.

2. Description of the Related Art

An image forming apparatus such as a printer includes a developing mechanism for supplying toner particles to an image bearing member and a toner container for replenishing the developing mechanism with the toner particles. This toner container has a container main body for storing the toner particles and is normally detachably mounted in a main body of the image forming apparatus so as to be replaceable as the toner particles are used up. This holds true for an ink cartridge of the ink-jet type in a printer or the like.

Generally, an image forming apparatus has a casing structure, and component members such as the above image bearing member, developing mechanism and toner container are accommodated in the casing so as not to be visible from the outside (see, for example, Japanese Unexamined Patent Publication NO. 2006-23347). Upon replacing the toner container, a user opens an opening cover of the casing, takes the used toner container out from the inside of the casing, mounts a new toner container and closes the opening cover. The user can see the toner container only when the opening cover is open.

In a conventional image forming apparatus, a user cannot know which toner container is actually mounted with the opening cover closed. In other words, the manufacturer and model number of the toner container mounted in the main body of the image forming apparatus cannot be known, and the opening cover had to be opened in order to know these. Accordingly, the user had to confirm the model number and the like by opening the opening cover every time despite its cumbersomeness, for example, in the case of ordering a new toner container or in the case of being required to notify the model number of the toner container at the time of requesting maintenance.

SUMMARY OF THE INVENTION

An object of the present invention is to provide an image forming apparatus enabling a user to confirm a consumable supplying member such as a toner container or an ink cartridge mounted in an image forming apparatus main body from the outside and an apparatus for receiving the consumable supplying member.

In order to accomplish this object, one aspect of the present invention is directed to an image forming apparatus, comprising an apparatus main body having a casing structure and adapted to perform an image forming operation; a window provided on a casing of the apparatus main body for enabling the interior of the apparatus main body to be seen; and an indicator provided in the apparatus main body for displaying specified indication information, the indicator being arranged at such a position as to face the window.

In this construction, it is preferable that a consumable supplying member to be detachably mounted in the apparatus main body is further provided; that the window enables a part of the consumable supplying member to be seen with the consumable supplying member mounted in the apparatus main body; and that the indicator is provided on the outer surface of the consumable supplying member at such a position as to face the window with the consumable supplying member mounted in the apparatus main body.

Another aspect of the present invention is directed to a consumable supplying member receiving apparatus, comprising an apparatus main body having a casing structure; a consumable supplying member to be detachably mounted in the apparatus main body; a window provided on a casing of the apparatus main body for enabling a part of the consumable supplying member to be seen with the consumable supplying member mounted in the apparatus main body; and an indicator provided on the apparatus main body for displaying specified indication information, the indicator being arranged at such a position as to face the window with the consumable supplying member mounted in the apparatus main body.

These and other objects, features, aspects and advantages of the present invention will become more apparent upon a reading of the following detailed description and accompanying drawings.

BRIEF DESCRIPTION OF THE DRAWINGS

FIGS. 6A to 6E are schematic top views showing variations of the shape of a window.

DETAILED DESCRIPTION OF THE PREFERRED EMBODIMENTS hereinafter, embodiments of the present invention are described with reference to the accompanying drawings.

First Embodiment

Figure 1:
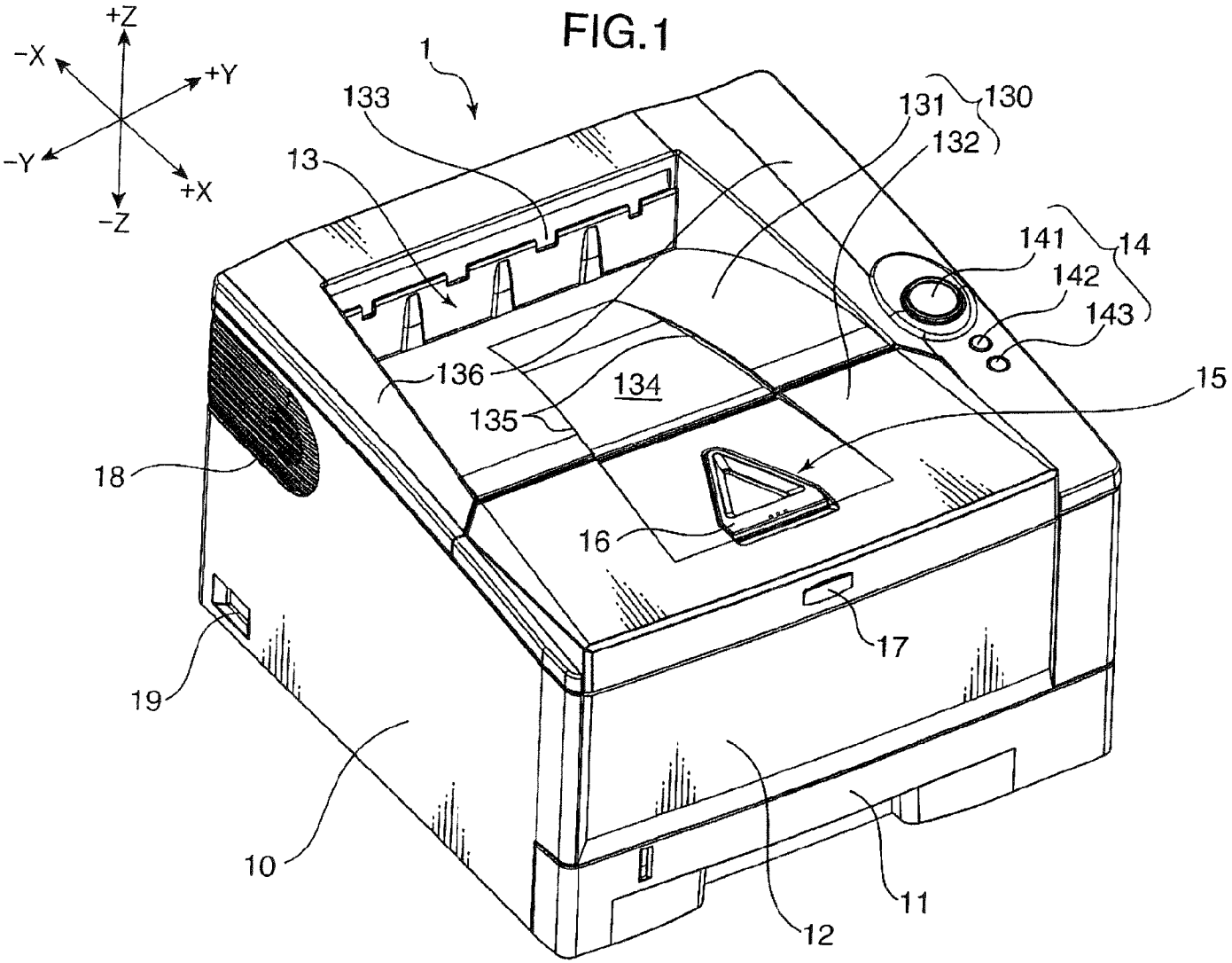
FIG. 1 is a perspective view showing the external appearance of a printer according to a first embodiment of the invention.

FIG. 1 is a perspective view showing the external appearance of a printer 1 according to one embodiment of an image forming apparatus (apparatus for receiving a consumable supplying member) of the present invention. In FIG. 1, X-X directions are forward and backward directions, Y-Y directions are transverse directions, and Z-Z directions are vertical directions, wherein +X direction is forward direction; −X direction backward direction; +Y direction rightward direction; −Y direction leftward direction; +Z direction upward direction; and −Z direction downward direction. This holds true for other figures affixed with direction indicators.

The printer 1 (image forming apparatus) performs an image forming operation and an image transferring operation based on image information inputted from an external apparatus such as a personal computer. The printer 1 is constructed such that various devices for image formation are mounted in an apparatus main body 10 having a casing structure in the form of a quadrangular prism.

A sheet cassette 11 is mounted at the bottom of the front surface of the apparatus main body 10. The sheet cassette 11 is a drawer container for storing a sheet stack P1 (see FIG. 2) as a collection of sheets P to which images are transferred, and is detachably mounted in the apparatus main body 10.

A manual sheet feeder 12 is provided above the sheet cassette 11. The manual sheet feeder 12 includes a rectangular plate-like member and has the bottom end thereof mounted in such a manner as to be rotatable relative to the front part of the apparatus main body 10, thereby being able to be opened and closed relative to the apparatus main body 10 (see FIG. 2). A user can feed a sheet by setting this manual sheet feeder 12 in an open state in the case of wishing manual sheet feed instead of automatic sheet feed from the sheet cassette 11. The outer surface of the manual sheet feeder 12 doubles as a decorative plate for the front part of the apparatus main body 10.

A discharge unit 13 is provided on the upper surface of the apparatus main body 10. The discharge unit 13 is formed by partly recessing the upper surface of the apparatus main body 10 and receives a printed sheet on the recessed bottom surface (sheet receiving surface 130). The sheet receiving surface 130 is formed by a curved plate 131 located at the back side of the upper surface of the apparatus main body 10 and an opening cover 132 located at the front side.

The curved plate 131 has such a moderately curved surface that the downward inclination thereof gradually increases from the front side toward the back side and a part adjacent to a sheet discharge port 133 is at the lowest position. The opening cover 132 is a flat member and assembled in a state moderately inclined down so as to be connected with the front end edge of the curved plate 131. With such a discharge unit 13, a plurality of sheets discharged from the sheet discharge port 133 have the trailing ends thereof in a conveying direction aligned near the sheet discharge port 133 by the inclination of the sheet receiving surface 130.

Figure 3:
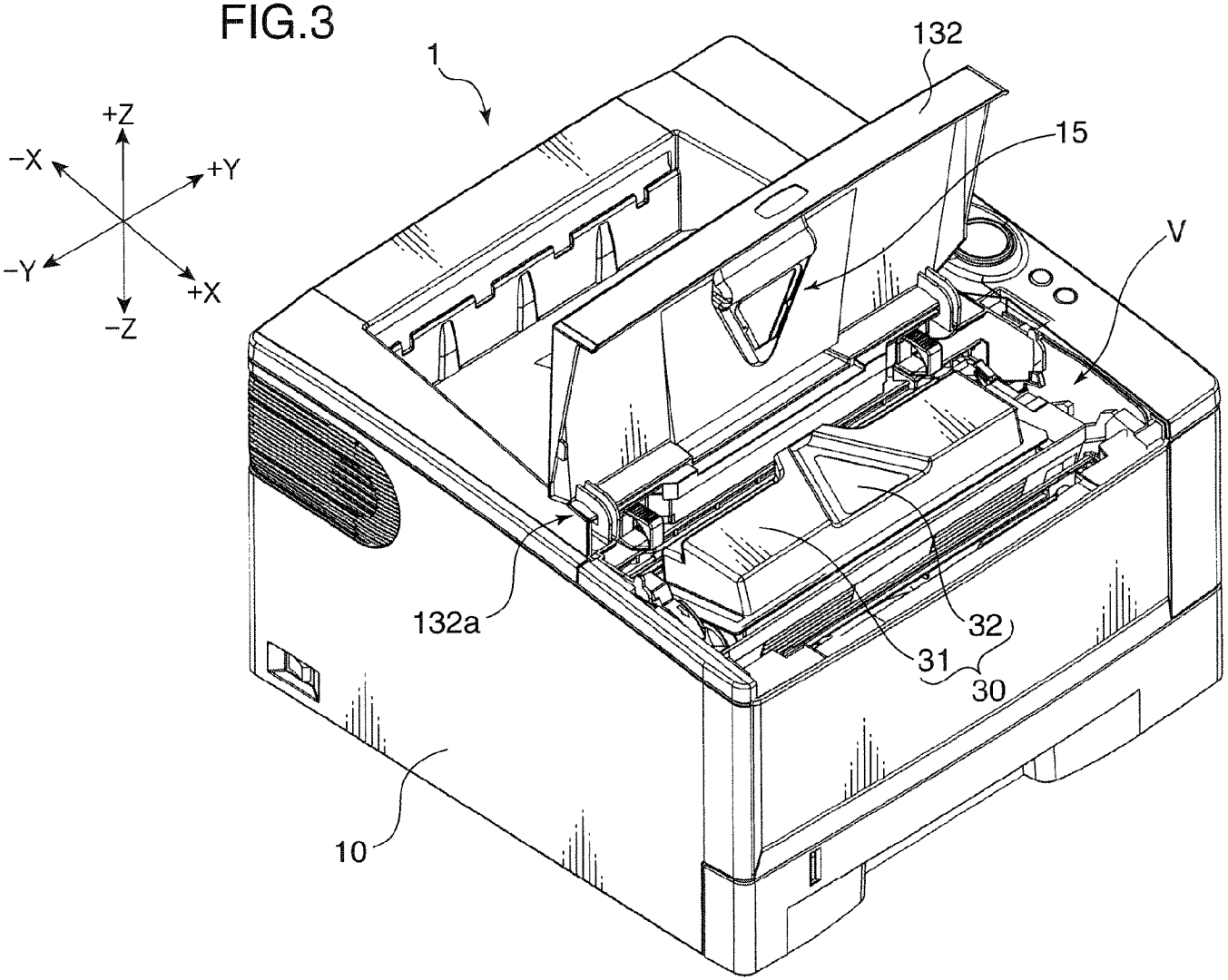
FIG. 3 is a perspective view showing a state where a toner container is mounted in an apparatus main body.
Figure 4:
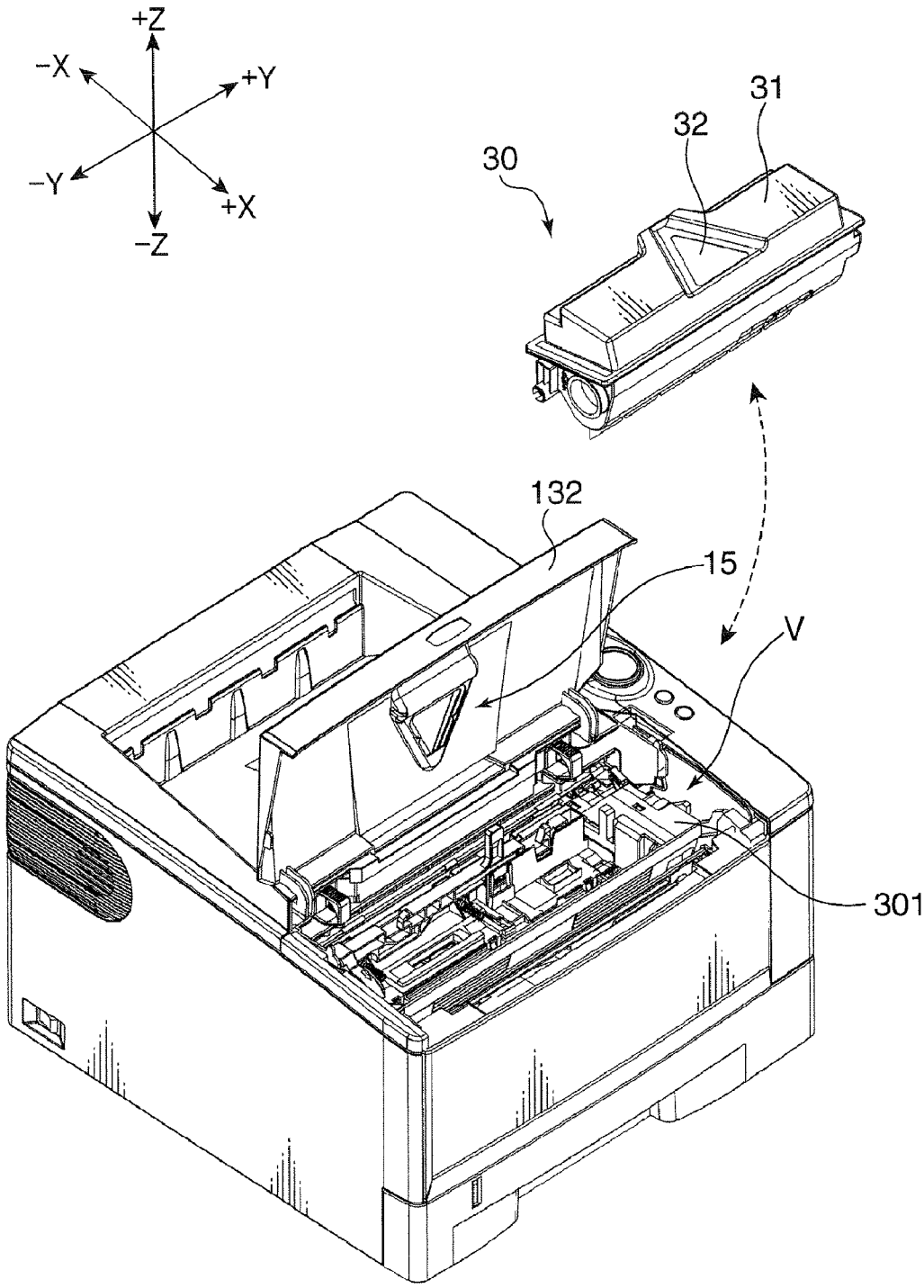
FIG. 4 is a perspective view showing a state where the toner container is detached from the apparatus main body.

The opening cover 132 is opened upward with the rear end edge thereof as an axis of rotation (see FIGS. 3 and 4). The opening cover 132 is opened and closed upon replacing a toner container 30. Further, a confirmation portion 15 including a window 152 (see FIG. 5) enabling a part of the toner container 30 to be seen is provided in the transverse center of the opening cover 132. A triangular auxiliary tray 16 is mounted on the confirmation portion 15. These are described in detail later.

The sheet receiving surface 130 is formed with a recessed surface 134 extending in forward and backward directions from the curved plate 131 to the opening cover 132. This recessed surface 134 is for reducing the contact resistance of a sheet with the sheet receiving surface 130 and ensuring smooth sheet discharge. The recessed surface 134 has left and right lateral steps 135 widened from the back side toward the front side. Similarly, the sheet receiving surface 130 is widened from the back side toward the front side, and upper walls 136 located at the left and right sides of the sheet receiving surface 130 are narrowed from the back side toward the front side. Accordingly, the depth and aerodynamic surface shape created by the presence of the above lateral steps 135 and upper walls 136 give a stylish and speedy aesthetic impression to the user operating (seeing) from the front side of the apparatus main body 10.

An operation panel unit 14 is provided on the right upper wall 136. The operation panel unit 14 is for receiving the operation of the user to the printer 1 and displaying information on the operation of the printer 1. Here is illustrated the operation panel unit 14 provided with a display 141 including an indicator for displaying stored states of sheets and toner particles and an occurrence of a jam, a cancel key 142 for interrupting a printing operation and a start key 143 for instructing a printing operation. Besides the above, a manufacturer emblem 17 is provided on the outer front surface of the apparatus main body 10, and a vent 18 and a power switch 19 are respectively provided on the left surface.

As described above, an outer casing (casing) of the apparatus main body 10 is partly constructed by decorative surfaces (front surfaces) of the sheet cassette 11 and the manual sheet feeder 12 and the sheet receiving surface 130 (upper surface) of the discharge unit 13. The color of the outer casing may be a monochromatic color such as an ivory color, but it is preferable to let, for example, the sheet receiving surface 130 or the decorative surface of the manual sheet feeder 12 and the sheet receiving surface 130 have a deeper (darker) color as compared to other parts. By doing so, it is possible not only to improve the design by two-tone colors, but also to make the sheet discharged onto the sheet receiving surface 130 easily recognizable by the user. In this case, the color of the sheet receiving surface 130 and the like may be, for example, 2 or smaller in lightness represented by Munsell values of the Munsell chart (JIS) and a difference in lightness between the color of the sheet receiving surface 130 and the like and that of the other parts may be 3 or greater in the Munsell value of the Munsell chart (JIS).

Figure 2:
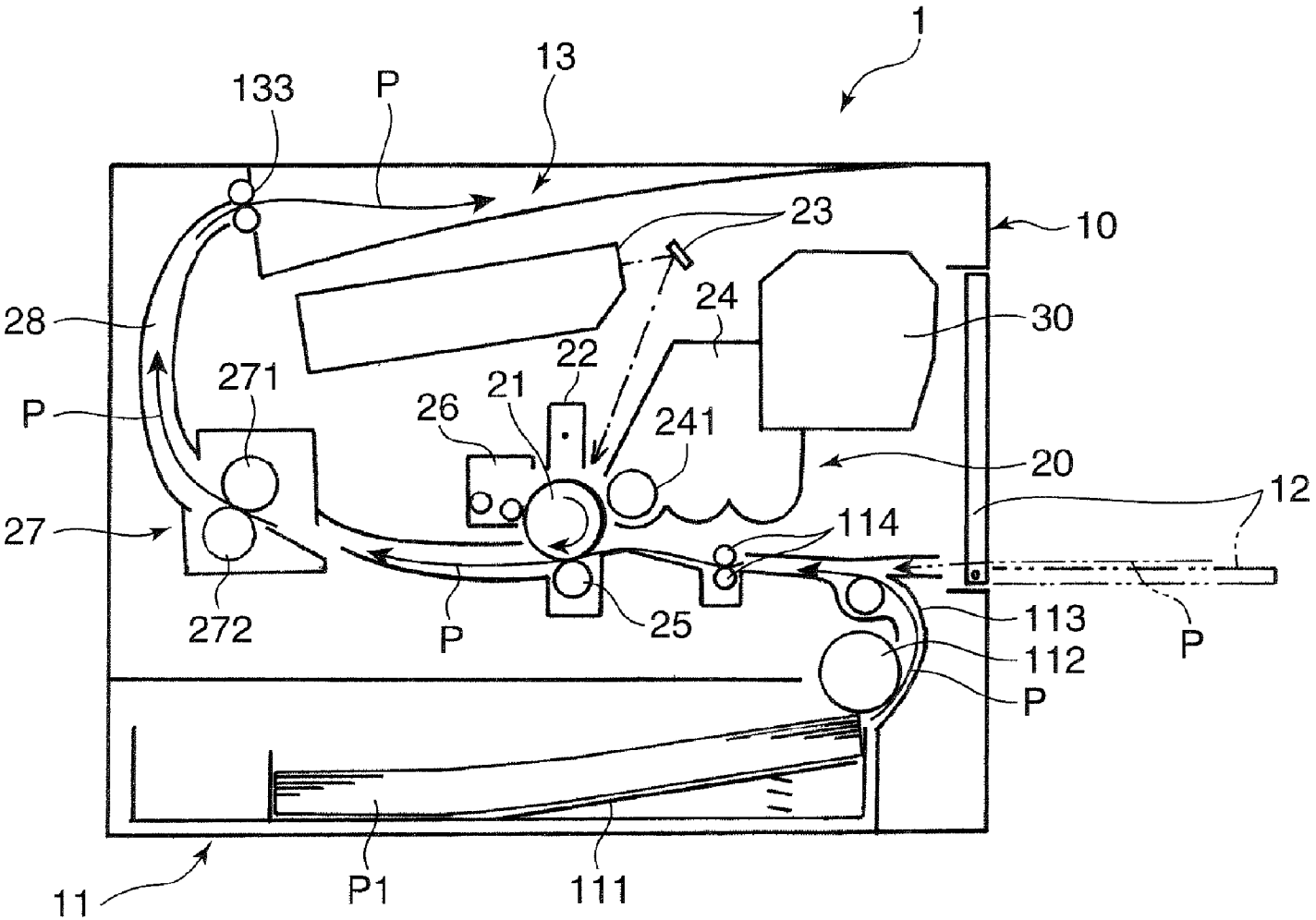
FIG. 2 is a schematic lateral section of the printer of FIG. 1 along forward and backward directions.

Next, the internal construction of the printer 1 is described. FIG. 2 is a schematic lateral section of the printer of FIG. 1 along forward and backward directions. The printer 1 includes the aforementioned sheet cassette 11, an image forming assembly 20 and a fixing device 27 in the apparatus main body 10. The sheet cassette 11 stores the stack P1 of sheets used for printing. The image forming assembly 20 performs an image transfer process to sheets P fed one by one from the sheet stack P1 stored in the sheet cassette 11 or fed from the aforementioned manual sheet feeder 12. The fixing device 27 applies a fixing process to the sheet P having the image transfer process applied thereto.

A lifter 111 is provided in the sheet cassette 11 to lift up a dispensing end (downstream end) of the sheet stack P1. A pickup roller 112 for dispensing the sheets P one by one from the sheet stack P is provided at the downstream end of the sheet cassette 11, and the end of the sheet stack P1 lifted up by the lifter 111 is held in contact with the pickup roller 112. The sheet P dispensed by the driving of this pickup roller 112 is fed to the image forming assembly 20 via a sheet conveyance path 113 and a pair of registration rollers 114 disposed at the downstream end of the sheet conveyance path 113. The sheet P fed from the manual sheet feeder 12 is conveyed to the pair of registration rollers 114 via an unillustrated feed roller.

The image forming assembly 20 transfers a toner image to the sheet P based on an image data given from an external apparatus. The image forming assembly 20 includes a photoconductive drum 21 rotatably provided about a drum center axis extending in transverse direction, and a charger 22, an exposing device 23, a developing device 24 (developing mechanism), a transfer roller 25 and a cleaning device 26 arranged along the circumferential surface of the photoconductive drum 21.

The photoconductive drum 21 is for forming an electrostatic latent image and a toner image in conformity with this electrostatic latent image on the circumferential surface thereof. An amorphous silicon photoconductive drum having an amorphous silicon layer formed on the circumferential surface thereof is suitably used as the photoconductive drum 21.

The charger 22 is for uniformly charging the circumferential surface of the photoconductive drum 21 rotating clockwise about the drum center axis. Here, a charger of the type to impart electric charges to the circumferential surface of the photoconductive drum 21 by corona discharge is illustrated as the charger 22. Instead of such a charger 22, a charging roller for imparting electric charges to the photoconductive drum 21 while being rotated by the photoconductive drum 21 with the circumferential surface thereof held in contact with the circumferential surface of the photoconductive drum 21 may be used.

The exposing device 23 irradiates the circumferential surface of the rotating photoconductive drum 21 with a laser beam modulated based on the image data. Electric charges are removed from parts of the circumferential surface of the photoconductive drum 21 irradiated with the laser beam, whereby an electrostatic latent image in conformity with a laser beam irradiation pattern is formed on the circumferential surface of the photoconductive drum 21.

The developing device 24 supplies toner particles to the circumferential surface of the photoconductive drum 21 via a developing roller 241 built therein. When the toner particles are supplied to the photoconductive drum 21, it is attached to a part where the electrostatic latent image is formed, whereby a toner image is formed on the circumferential surface of the photoconductive drum 21. The toner container is detachably attached to the developing device 24, and toner particles are replenished from this toner container when the toner particles in the developing device 24 are used up.

The transfer roller 25 forms a nip portion together with the photoconductive drum 21 and transfers the toner image formed on the circumferential surface of the photoconductive drum 21 to a sheet P fed to the nip portion. The toner image on the circumferential surface of the photoconductive drum 21 is positively charged. On the other hand, the transfer roller 25 imparts negative electric charges having a polarity opposite to the electric charges of the toner image to the sheet P. The positively charged toner image on the circumferential surface of the photoconductive drum 21 is peeled off toward the front side of the negatively charged sheet P to be transferred to the sheet P.

The cleaning device 26 cleans the circumferential surface of the photoconductive drum 21 by removing the toner residual thereon after the transfer process. The circumferential surface of the photoconductive drum 21 cleaned by this cleaning device 26 moves toward the charger 22 again for a next image forming process.

The fixing device 27 is for fixing the toner image transferred to the sheet P in the image forming assembly 20 to the sheet P by heating. The fixing device 27 includes a heat roller 271 having an electric heating element mounted therein and a pressure roller 272 whose circumferential surface is opposed to that of the heat roller 271. The sheet P after the transfer process passes through a nip portion between the heat roller 271 driven to rotate and the pressure roller 272 rotated by the heat roller 271 in an opposite direction to have the fixing process applied thereto by obtaining heat from the heat roller 271. The sheet P having the fixing process applied thereto is discharged to the discharge unit 13 via a sheet discharge path 28. The sheet discharge path 28 is a conveyance path along which sheets P of the respective sizes are discharged with reference to a center line of a width direction (direction normal to a sheet conveying direction) of the sheet receiving surface 130.

FIGS. 3 and 4 are perspective views showing a mounted state of the toner container (consumable supplying member) in the apparatus main body 10, wherein FIG. 3 shows a state where the toner container 30 is mounted in the apparatus main body 10 (developing device 24) and FIG. 4 shows a state where the toner container 30 is detached from the apparatus main body 10.

In the case of replacing the toner container 30, the user grips the front end of the opening cover 132 and lifts it upward to turn the opening cover 132 by about 90° about a rotary shaft 132*a*, whereby the opening cover 132 is set in an open state. By this operation, the toner container 30 mounted in an accommodation space V in the apparatus main body 10 is exposed as shown in FIG. 3.

Subsequently, the toner container 30 is taken out of the accommodation space V by lifting the left and right surfaces of the toner container 30 with both hands (see FIG. 4). Then, a new toner container 30 filled with toner particles is mounted in the accommodation space V. At this time, the toner container 30 needs to be mounted while being exactly positioned with an installation portion 301 provided on the upper surface of the developing device 24. In other words, the user needs to mount the toner container 30 in a correct installation direction, so that a toner outlet, a drive gear of an agitator and the like of the toner container 30 are positioned with a toner reception port, a driver of the agitator and the like of the installation portion 301. After the new toner container 30 is mounted, the opening cover 132 is closed.

In the printer 1 constructed as described above, the confirmation portion 15 is provided on the opening cover 132 in this embodiment to know the toner container 30 actually mounted in the apparatus main body 10 even when the opening cover 132 is closed and further to show a transverse center position of the discharge unit 13 (sheet receiving surface 130). Further, an indicator 32 (visual confirmation portion) arranged at a position facing the confirmation portion 15 with the toner container 30 mounted in the apparatus main body 10 is provided on the upper surface of a container main body 31 of the toner container 30. These constructions are described in detailed below.

Figure 5:
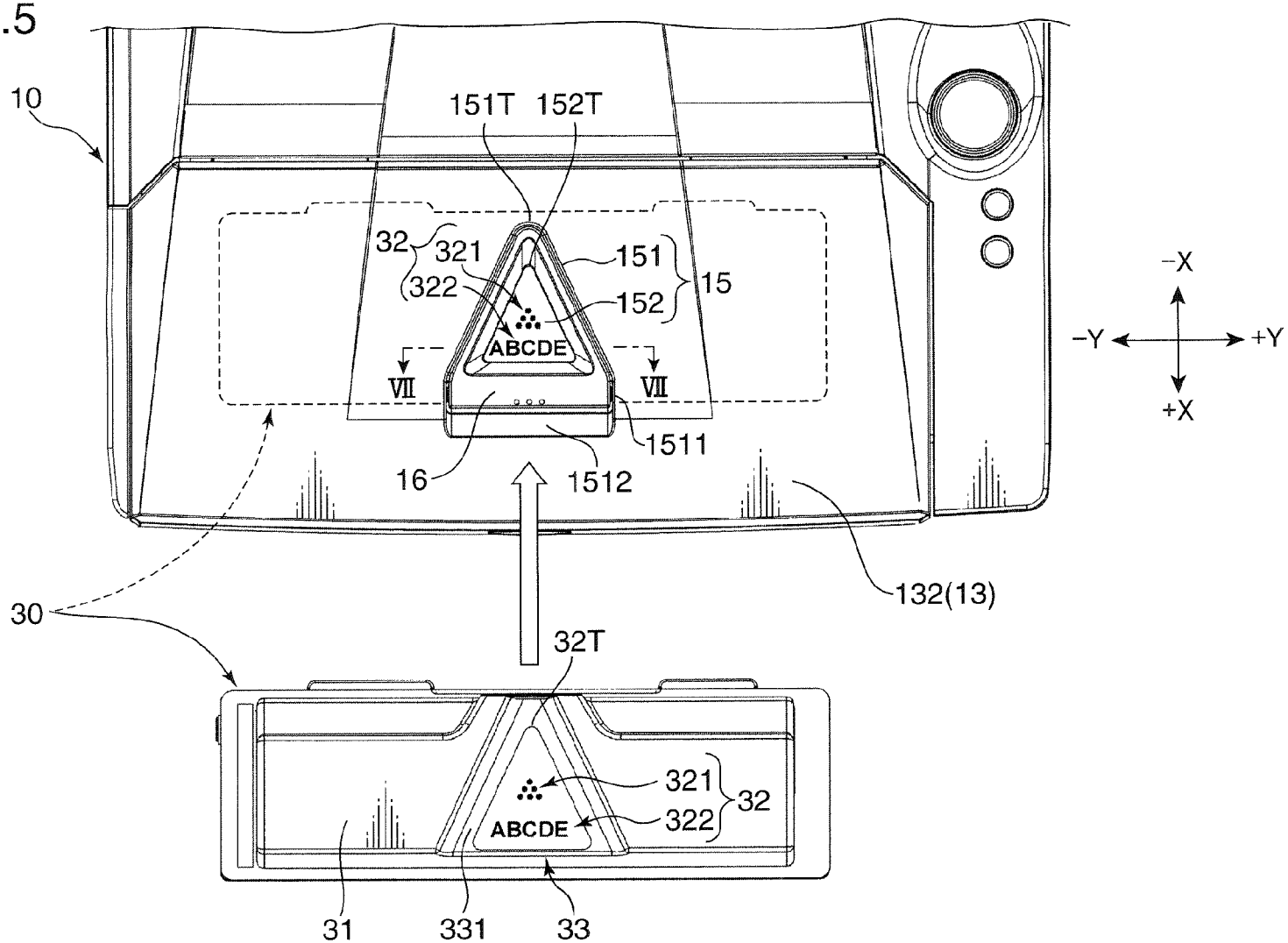
FIG. 5 is a top view of an opening cover and the toner container.

FIG. 5 is a top view of the opening cover 132 and the toner container 30. The confirmation portion 15 is provided at the center position of the opening cover 132 with respect to both transverse direction and forward and backward directions. In this embodiment, the confirmation portion 15 includes a window recess 151 formed by recessing the opening cover 132 at the above center position (recess formed by recessing a part of the casing) and a window 152 provided at the bottom surface of the window recess 151.

By providing the window 152 at the bottom surface of the window recess 151 instead of providing it in flush with the opening cover 132, the interference of the window 152 with sheets discharged to the discharge unit 13 and other objects can be suppressed and the window 152 can be prevented from being scratched and smeared. On the other hand, since the recess is present at the front side of the discharge unit 13 with respect to the sheet conveying direction, i.e. at a position where the user holds the sheet discharged to the discharge unit 13 for removal, there is an advantage that the user can easily hold a sheet end. Further, the user can grasp the widthwise center position of the sheet by recognizing the window recess 151 by touch.

For example, a transparent plastic plate can be used as the window 152. The window recess 151 is a recess substantially triangular when viewed from above and the window 152 has a triangular shape one size smaller than the window recess 151. Both shapes have directivities.

The window 152 has an isosceles triangular shape having a bottom side parallel to the front edge of the apparatus main body 10 and an apex 152T faced backward. The window recess 151 has an analogous isosceles triangular shape and includes a parallel section 1511 before the above bottom side and an inclined surface 1512 at the front side of the parallel section 1511. The parallel section 1511 is where a rotary shaft enable the upward rotation of the auxiliary tray 16 is formed. The inclined surface 1512 supports the auxiliary tray 16 rotated upward by a specified angle.

In a positional relationship with the discharge unit 13, the apex 152T of the window 152 and an apex 151T of the window recess 151 are located at the front side with respect to the sheet conveying direction and at the transverse center position of the sheet receiving surface 130. Further, the apices 151T, 152T are faced toward the rear side with respect to the sheet conveying direction. By having such a positional relationship, the user can know the widthwise center position of the sheet discharged to the discharge unit 13.

Accordingly, even if a multitude of sheets are stacked up on the sheet receiving surface 130 to form a thick sheet stack, the user can recognize the center of the sheet stack and grab the sheet stack at this center position in a well-balanced manner. Thus, even users having weak hands or users sitting on wheelchairs can stably remove the sheet stack from the sheet receiving surface 130 without disrupting a stacked state of the sheets.

In a relationship with the toner container 30, the apex 152T of the window 152 and the apex 151T of the window recess 151 are faced in the installation direction of the toner container 30 into the apparatus main body 10. In the printer 1 of this embodiment, the toner container 30 is installed from the front side of the apparatus main body 10 as shown in FIGS. 4 and 5. In order to simply show this installation direction of the toner container 30 to the user, the window 152 and the window recess 151 have transversely symmetric triangular shapes with the apices 152T, 151T thereof faced backward from the front side of the apparatus main body 10. Thus, the user can install the toner container 30 into the apparatus main body 10 by being navigated by the facing direction of the apices 152T, 151T and, therefore, it can be prevented to install the toner container 30 in a wrong mounting direction. Further, since the window 152 and the window recess 151 have symmetric shapes having the apices faced in the installation direction, design can be improved.

Variations of the shape of the window 152 (window recess 151) are shown in FIGS. 6A to 6E. A window 152*a* shown in FIG. 6A has an isosceles triangular shape similar to the window 152 shown in FIG. 5. A window 152*b* shown in FIG. 6B has a substantially triangular shape (or pentagonal shape) with a parallel extended section attached at the bottom side. A window 152*c* shown in FIG. 6C is shaped such that two sides extending to an apex are transversely symmetrical curves. A window 152*d* shown in FIG. 6D has a substantially triangular shape whose apex is a curve instead of an acute angle and which has a parallel extended section attached at the bottom side. A window 152*e* shown in FIG. 6E has a substantially triangular shape (or hexagonal shape) with an apex section parallel to the bottom side and a parallel extended section attached at the bottom side. In this way, the shape of the window 152 (window recess 151) preferably has a transversely symmetrical shape whose apex is formed by straight lines or curves to face in the installation direction of the toner container 30. However, the window 152 may also be shaped to have no directivity and may, for example, have a circular or rectangular shape.

The toner container 30 includes the container main body 31 and the indicator 32 provided on the upper surface of the container main body 31. The container main body 31 has a casing structure, and toner particles are stored inside. The agitator for agitating the toner particles, a conveyance screw for guiding the toner particles to the toner discharge port (not shown) formed in the bottom wall of the container main body 31 and the like are also provided in the container main body 31.

The indicator 32 is provided on the upper surface of the container main body 31 for displaying specified indication information. The indicator 32 is arranged at a position to face the confirmation portion 15 with the toner container 30 mounted in the apparatus main body 10. Further, the indicator 32 has an isosceles triangular shape having substantially the same size as the window 152 and is positioned in alignment with the correct mounting direction of the toner container 30 into the apparatus main body 10.

As shown in FIG. 5, the indicator 32 is provided on the upper surface of the container main body 31 so as to face and conform in shape to the window 152, i.e. so as to conform the apex 152T of the window 152 and an apex 32T of the indicator 32 when the toner container 30 is mounted into the apparatus main body 10 in the correct direction. In other words, the indicator 32 has a transversely symmetrical triangular shape having the apex 32T faced in the installation direction of the toner container 30 similar to the window 152. By letting the window 152 and the indicator 32 have directivities in this way, the user can easily notice an erroneous mounting based on a difference between the directivities of the window 152 and the indicator 32 in the case of attempting to mount the toner container 30 into the apparatus main body 10 in a wrong direction. The shapes illustrated in FIGS. 6A to 6E may also be adopted as variations of the shape of the indicator 32.

The indicator 32 may be a seal having an adhesive surface capable of adhering to the container main body 31 on the underside thereof or the like. In this embodiment is shown an example in which an indicator recess 33 substantially triangular when viewed from above is provided in the center of the upper surface of the container main body 31, and a seal for the indicator 32 is attached to a bottom surface 331 thereof. The indicator 32 includes a dingbat indicator 321 for displaying a dingbat indicating toner particles and a character indicator 322 indicating the manufacturer name ("ABCDE" in FIG. 5) as indication information. Besides, symbols other than characters may be displayed in the indicator 32. Instead of forming the indicator 32 of the seal or the like, a triangular indicator including the above dingbat and characters may be directly formed on the upper surface of the container main body 31 by die machining.

If the front side of the apparatus main body 10 where the user is standing face to face with the printer 1 upon replacing the toner container 30 is set to be a reference side, the indication information such as characters, symbols or dingbats displayed on the indicator 32 is oriented in a correct direction when viewed from front when the toner container 30 is properly mounted in the apparatus main body 10. In other words, the characters "ABCDE" are so printed as to be normally made out by the user reading from the front side of the apparatus main body 10. Thus, if the toner container 30 is properly mounted in the apparatus main body 10, the user can read the indication information of the indicator 32 in a correct direction from front. Therefore, the user can easily see or read the indication information and, if the toner container 30 is mounted in a wrong direction, such an error can be quickly noticed since the character information or the like is inverted.

In the printer 1 according to this embodiment, the window 152 is provided on the opening cover 132 constituting a part of the outer casing of the apparatus main body 10. Thus, external light can enter the apparatus main body 10 through the window 152. Since members susceptible to external light such as the photoconductive drum 21 are present in the apparatus main body 10, a light shielding structure (light shielding portion) for preventing the diffusion of incident light through the window 152 into the interior of the apparatus main body 10 is provided in the vicinity of the window 152. This light shielding structure is described with reference to FIG. 7.

Figure 7:
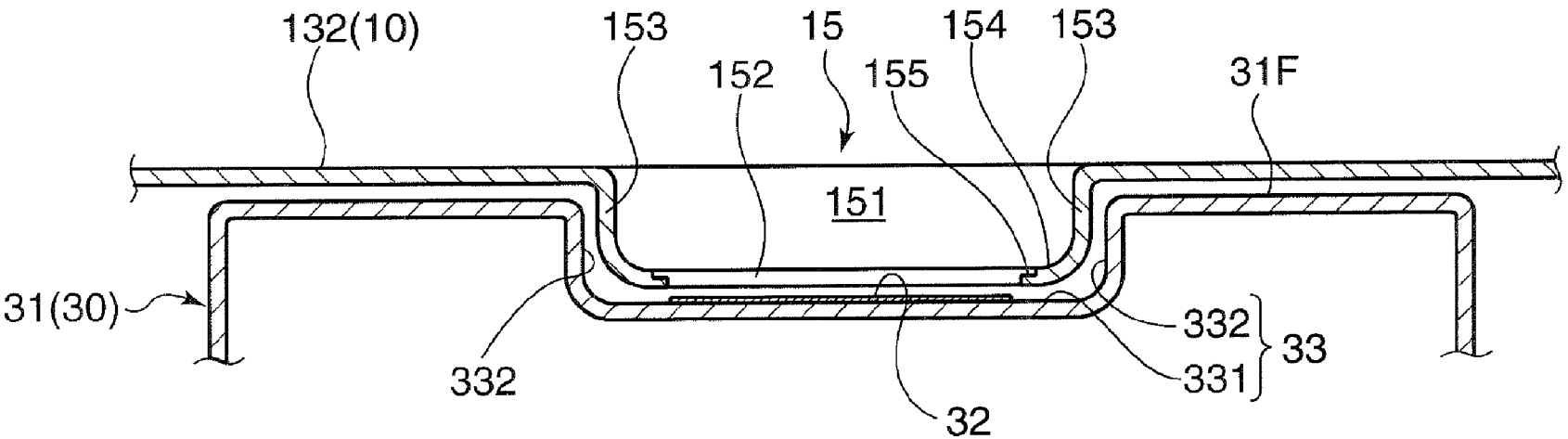
FIG. 7 is a section along VII-VII of FIG. 5.

FIG. 7 is a section along VII-VII of FIG. 5. It should be noted that the auxiliary tray 16 is not shown in FIG. 7 to simplify the drawing. As described above, the window 152 is provided at the bottom surface of the window recess 151 formed by recessing the part of the opening cover 132. The window recess 151 includes a side wall 153 extending in a recessing direction and a bottom wall 154 continuous with the side wall 153, and a transparent plate constituting the window 152 is fitted on an end edge 155 of the bottom wall 154.

The indicator recess 33 of the toner container 30 is provided on an upper surface 31F of the toner container 30 and includes a bottom surface 331 to which the seal constituting the indicator 32 is attached and a side wall 332 (light-blocking wall) continuous with the peripheral edge of the bottom surface 331. The indicator recess 33 has a triangular shape larger than the window recess 151 when viewed from above so as to be able to accommodate the window recess 151 and has such a depth as not to interfere with the window 152 with the opening cover 132 closed at a correct position.

The window 152 enters the indicator recess 33 beyond the upper surface 31F of the toner container 30 to come close to the bottom surface 331 (indicator 32) when the opening cover 132 is closed. The side wall 153 of the window recess 151 is opposed close to the side wall 332 of the indicator recess 33. Further, the underside of the opening cover 132 and the upper surface 31F of the toner container 30 are opposed close to each other. In other words, the indicator recess 33 and the window recess 151 projecting from the underside of the opening cover 132 are so shaped as to have directivities and the window recess 151 is accommodated inside the side wall 332 defining the indicator recess 33 when the toner container 30 is mounted in a correct installation direction.

Accordingly, external light incident through the window 152 is prevented from diffusing into the interior of the apparatus main body 10 by the bottom surface 331 of the indicator recess 33 close to the bottom wall 154, the side wall 332 close to the side wall 153 and the upper surface 31F close to the underside of the opening cover 132. On the other hand, toner particles may fly in the interior of the apparatus main body 10, but are unlikely to reach the lower surface of the window 152 due to the presence of the bottom surface 331, the side wall 332 and the upper surface 31F, whereby the smearing of the window 152 is suppressed.

Figure 8:
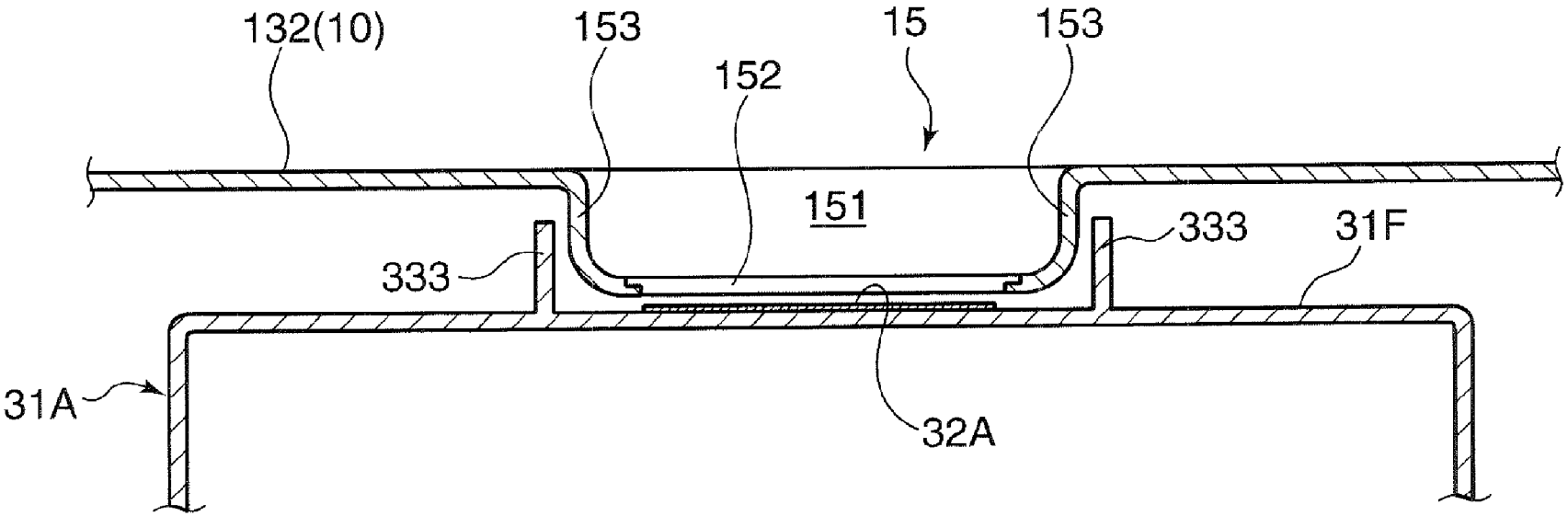
FIG. 8 is a section along VII-VII of FIG. 5 showing a modification.

FIG. 8 is a section along VII-VII of FIG. 5 showing another embodiment of the light-shielding structure. Here is shown an example in which a rib 333 (light shielding wall) stands on an upper surface 31F of a toner container 30A to surround the window recess 151 projecting from the underside of the opening cover 132. In other words, the rib 333 has a substantially triangular shape slightly larger than the window recess 151 when viewed from above. The rib 333 is opposed close to the side wall 153 of the window recess 151 when the opening cover 132 is closed. The toner container 30A provided with such a rib 333 has the aforementioned effects of shielding light and hindering flying toner particles.

Figure 9A:
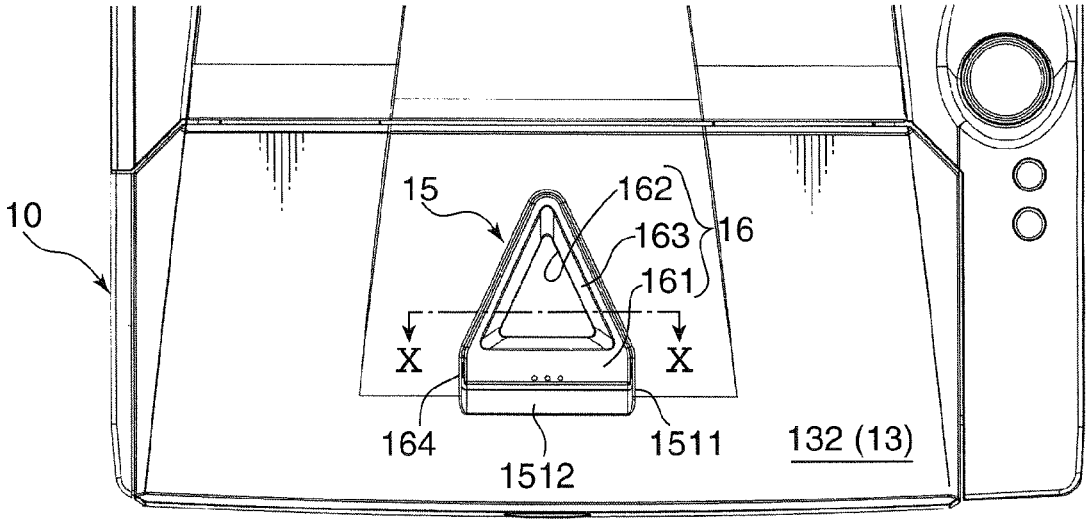
FIG. 9A is a top view of an auxiliary tray at an accommodated position and FIG. 9B is a top of the auxiliary tray at an unfolded position.
Figure 9B:
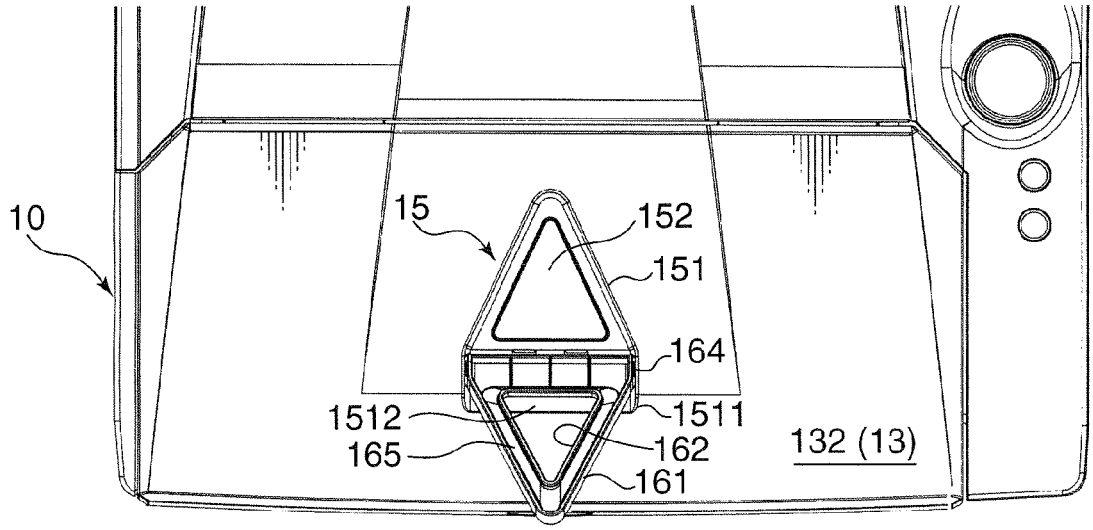
Figure 10:
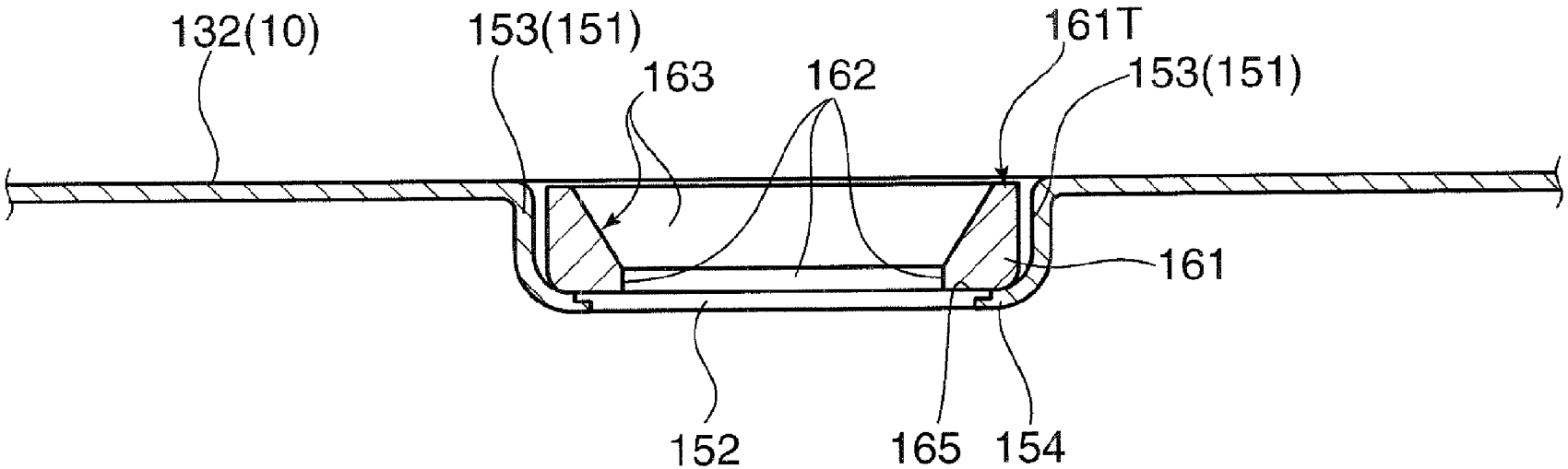
FIG. 10 is a section along X-X of FIG. 9A.

Next, the auxiliary tray 16 is described with reference to FIGS. 9A to 11. FIG. 9A is a top view showing an accommodated position where the auxiliary tray 16 is accommodated in a recess of the confirmation portion 15 (window recess 151), and FIG. 9B is a top view showing an unfolded position where the auxiliary tray 16 is lifted up and turned to support the leading end of a sheet discharged to the discharge unit 13 with respect to the sheet conveying direction. FIG. 10 is a section along X-X of FIG. 9A.

The auxiliary tray 16 is used to auxiliarily support sheets upon discharging large-size sheets to the discharge unit 13 or upon better aligning sheets, in the form of a triangular frame and rotatably mounted on the confirmation portion 15 of the opening cover 132. The auxiliary tray 16 includes a frame portion 161, an opening surrounding wall 162, slants 163, a rotary portion 164 and a sheet supporting surface 165.

The frame portion 161 is a triangular frame member engageable with the window recess 151 and having an opening inside. As shown in FIG. 10, the frame portion 161 has a thickness substantially equal to the depth of the window recess 151 and an upper surface 161T thereof is substantially flush with the upper surface of the opening cover 132 at the accommodated position. Such a small clearance as not to impair the rotatability of the auxiliary tray 16 is defined between the outer surrounding wall of the frame portion 161 and the side wall 153 of the window recess 151.

The opening surrounding wall 162 is a triangular wall surface defining the above opening when viewed from above. This opening ensures the visibility of the window 152 upon mounting the auxiliary tray 16 utilizing the recess of the confirmation portion 15.

The slants 163 are inclined surfaces inclined down from the upper surface 161T of the frame portion 161 toward the opening surrounding wall 162. The slants 163 have a function of making the window 152 easier to see even in directions other than the one from right above. The window recess 151 tends to collect dust because of its concave surface. By providing the slants 163, the user can easily clean off not only dust remaining in the middle part of the window 152, but also dust remaining near the opening surrounding wall 162 of the window 152.

The rotary portion 164 is provided near the bottom side of the frame portion 161 and shaft-coupled to the parallel section 1511 of the window recess 151 to realize a lift-up and turning movement of the auxiliary tray 16. The auxiliary tray 16 is displaceable between the accommodated position where it is accommodated in the window recess 151 and the unfolded position where it auxiliarily support sheets by being turned about the rotary portion 164.

Figure 11:
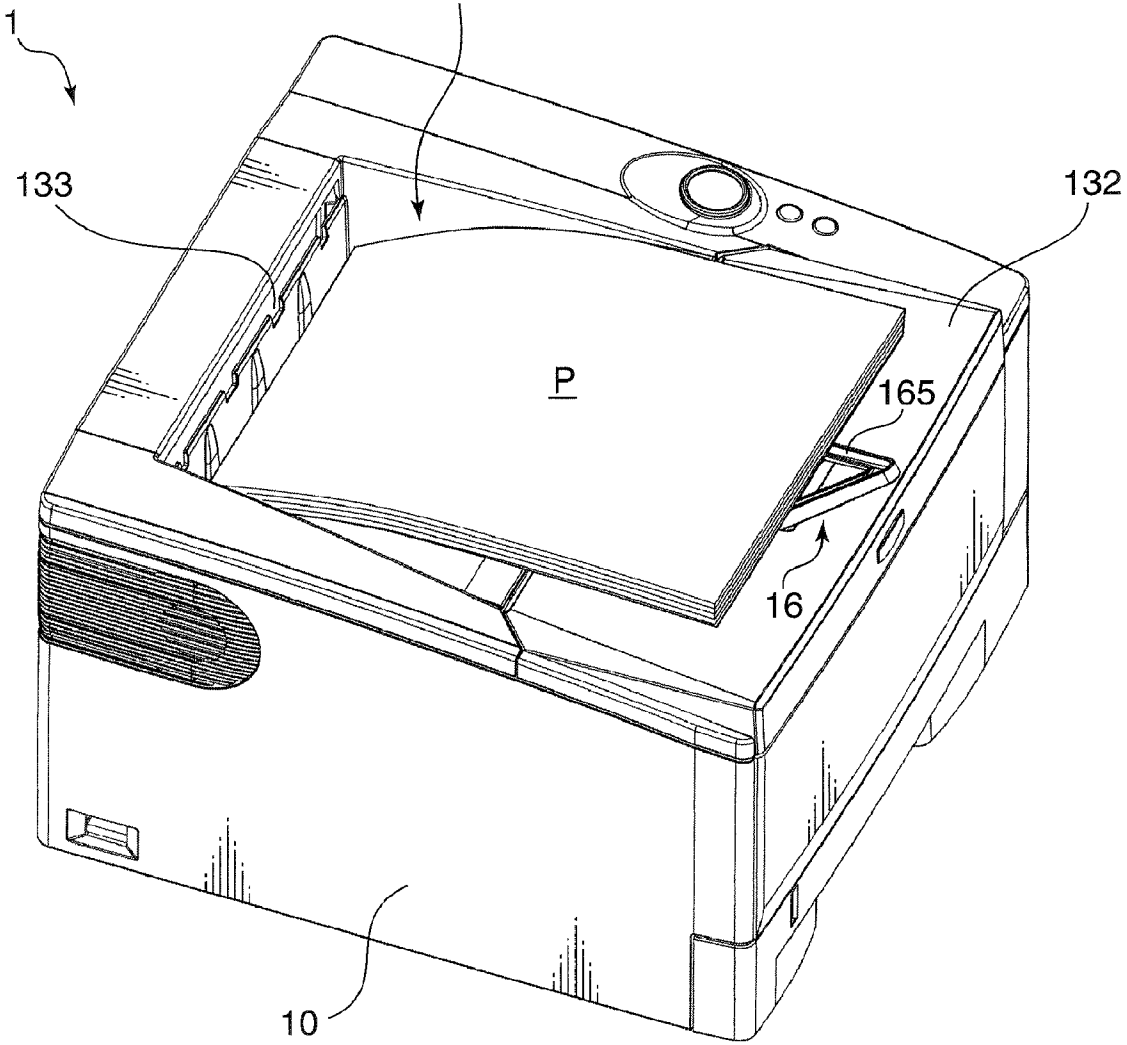
FIG. 11 is a perspective view showing a used state of the auxiliary tray.

The sheet supporting surface 165 is a triangular supporting surface located on the underside of the frame portion 161 for supporting sheets. As shown in FIG. 9B, the sheet supporting surface 165 appears on the upper surface of the discharge unit 13 when the auxiliary tray 16 is at the unfolded position. At this time, the upper surface 161T of the frame portion 161 is in contact with the inclined surface 1512 of the window recess 151 and the auxiliary tray 16 is in a stable state. Then, the sheet supporting surface 165 supports sheets P discharged to the discharge unit 13 as shown in FIG. 11. On the other hand, when the auxiliary tray 16 is at the accommodated position, the sheet supporting surface 165 is in contact with the bottom wall 154 of the window recess 151.

The user can normally accommodate the auxiliary tray 16 constructed as above in the window recess 151 and lift up and turn it to the unfolded position if necessary to support sheets discharged to the discharge unit 13. Since the auxiliary tray 16 is accommodated utilizing the confirmation portion 15, it is not necessary to separately ensure an accommodation space for the auxiliary tray 16. In addition, since the auxiliary tray 16 is formed with the opening, the visibility of the window 152 is not impaired. This auxiliary tray 16 can also be used as a grip upon opening the opening cover 132.

According to the printer 1 and the toner container 30 of this embodiment constructed as above, the user can confirm the indication information displayed on the indicator 32 of the toner container 30 through the window 152 from the outside of the printer 1. Thus, the user can know which toner container 30 is actually mounted in the apparatus main body 10 without opening the opening cover 132 extra. Hence, the user can quickly understand the model number of the toner container 30 and other necessary information, for example, at the time of ordering a new toner container 30 or requesting maintenance, wherefore user convenience can be improved.

Here, the image forming assembly including the photoconductive drum 21 might be influenced by external light because the outer casing of the apparatus main body 10 is provided with the window 152. However, the light shielding structure of fitting the projecting part of the window recess 151 into the indicator recess 33 of the toner container 30 when the opening cover 132 is closed is adopted in this embodiment. Accordingly, the side wall 332 mainly functions as a light shielding wall and the diffusion of external light into the interior of the apparatus main body 10 can be suppressed. Such a light shielding structure can also suppress the adhesion of toner particles, which might be flying in the apparatus main body 10, to the window 152.

Further, the window 152 is provided at the bottom surface of the window recess 151 and arranged at a position slightly lower than the sheet receiving surface 130. Thus, external forces are unlikely to act on the window 152 and scratches and smearing can be suppressed, wherefore the visibility of the window 152 can be ensured in a satisfactory manner over a long term.

Further, the window 152 is provided in the widthwise middle part of the opening cover 132 arranged at the leading end side in the sheet conveying direction and the apex 152T of the window recess 152 (apex 151T of the window recess 151) is located in the widthwise center of the sheet receiving surface 130. Thus, the user can utilize the window 152 (apex 152T) as a center indicator and can know the widthwise center position of a sheet discharged to the discharge unit 13.

Further, the auxiliary tray 16 can be assembled utilizing the confirmation portion 15 (window recess 151), can be normally accommodated in the window recess 151 and can auxiliarily support sheets by being turned according to needs. Further, the auxiliary tray 16 is formed with the opening to ensure the visibility of the window 152. Since the recess of the sheet receiving surface 130 provided for the window 152 is effectively utilized in this way, it is not necessary to ensure a separate accommodation space for the auxiliary tray 16. Further, the design of the sheet receiving surface 130 does not look complicated.

Second Embodiment

Next, a second embodiment of the present invention is described. In the second embodiment, an indicator is a remaining amount indicator for displaying the remaining amount of toner (consumable).

Figure 12:
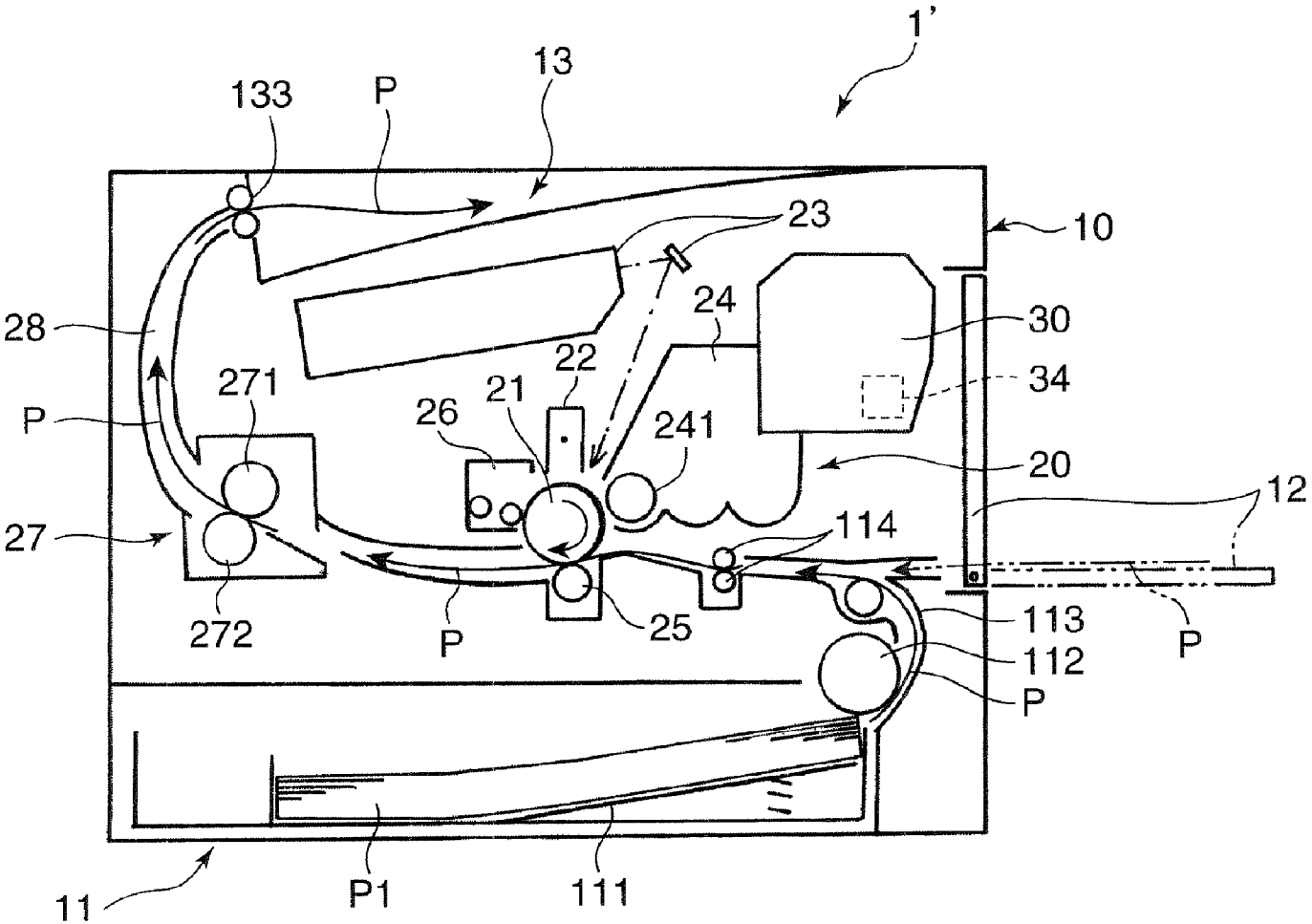
FIG. 12 is a schematic lateral section of a printer according to a second embodiment of the invention.

FIG. 12 is a schematic lateral section of a printer 1' according to the second embodiment. Parts identified by the same reference numerals as in FIG. 2 are identical parts. A point of difference from the first embodiment is that a toner remaining amount detecting sensor 34 (toner remaining amount detector) for detecting a toner remaining amount in the container is attached to the toner container 30.

The toner remaining amount detecting sensor 34 is, for example, a transmissive sensor including a light emitting element and a light receiving element, and is so disposed inside or outside the toner container 30 as to be turned off if light is blocked by the toner particles in the toner container 30 while being turned on if light is not blocked. In the case of disposing the toner remaining amount detecting sensor 34 outside the toner container 30, a part of the toner container 30 located on a light path from the light emitting element to the light receiving element may be made of a transparent material.

In the case of simply giving a toner shortage warning, one toner remaining amount detecting sensor 34 is disposed at a position where an ON-signal is outputted (where the light receiving element detects a specified light quantity) when the toner remaining amount runs short. In the case of detecting the toner remaining amount stepwise, a plurality of toner remaining amount detecting sensors 34 may be arranged at different height positions of the toner container 30. Although the transmissive sensor is used here, means for detecting a torque of an agitator agitating the toner particles in the toner container 30 or any other arbitrary means may be adopted as the toner remaining amount detector.

The printer 1' according to the second embodiment includes the toner remaining amount indicator for displaying specified indication information on the toner remaining amount. Such a toner remaining amount indicator is arranged at a position to face the window 152 (see FIG. 5) with the toner container 30 mounted in the apparatus main body 10. Various examples of the toner remaining amount indicator are described below. Here, a part of the indicator 32 described in the first embodiment serves as the toner remaining amount indicator.

Figure 13:
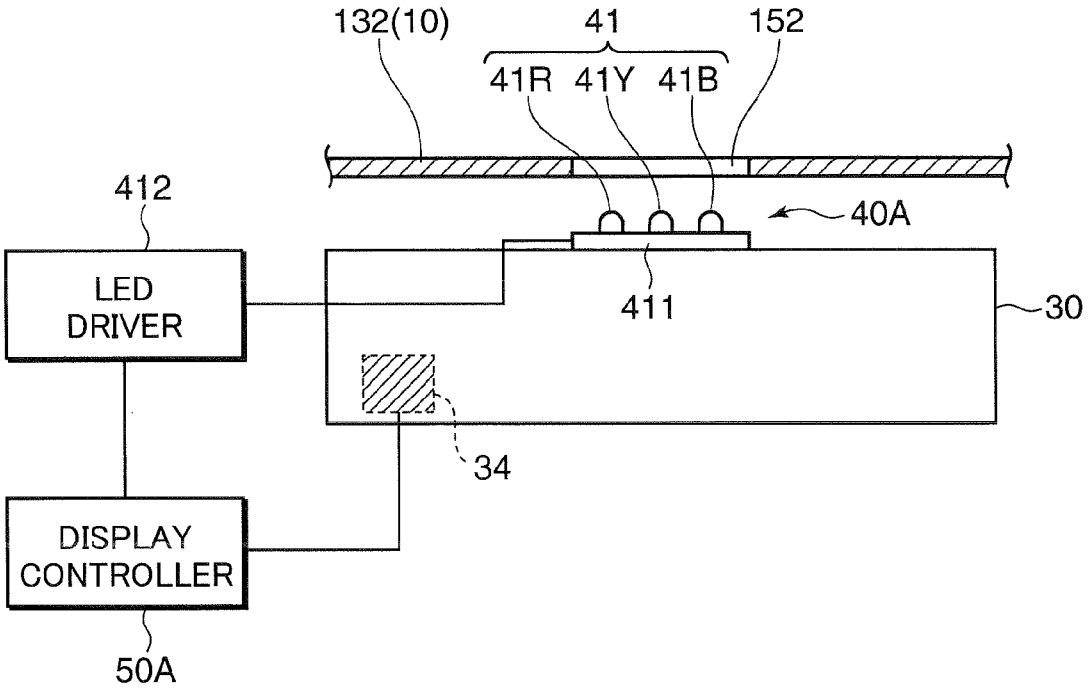
FIG. 13 is a diagram showing a first example of a toner remaining amount indicator in the second embodiment.

FIG. 13 is a diagram showing a toner remaining amount indicator 40A according to a first example. This toner remaining amount indicator 40A includes a plurality of light emitting elements 41 and a supporting substrate 411 supporting the light emitting elements 41. The light emitting elements 41 includes a red LED 41R, a yellow LED 41Y and a blue LED 41B, each of which has an emission direction oriented toward the window 152.

The red, yellow and blue LEDs 41R, 41Y and 41B are respectively driven (turned on) by an LED driver 412. The LED driver 412 is controlled by a display controller 50A. The display controller 50A includes a CPU or the like, and controls emission states of the red, yellow and blue LEDs 41R, 41Y and 41B in accordance with the detection result on the toner remaining amount in the toner container 30 by the toner remaining amount detecting sensor 34.

For example, the display controller 50A causes the blue LED 41B to emit light by controlling the LED driver 412 if the toner remaining amount is judged to be sufficient based on the detection result of the toner remaining amount detecting sensor 34. The user can know that sufficient toner remains in the toner container 30 by seeing the blue light emission of the blue LED 41B. On the other hand, the display controller 50A respectively causes the yellow LED 41Y and the red LED 41R when the toner remaining amount is little and when the toner particles is used up. Thus, the user can know the shortage of the toner.

In the above construction, incandescent electric lamps, EL light emitting elements or other small-size light emitting elements may be used as light emitting members in place of the LEDs. Alternatively, a liquid crystal display panel or the like capable of displaying character and/or symbol information may be used.

Figure 14:
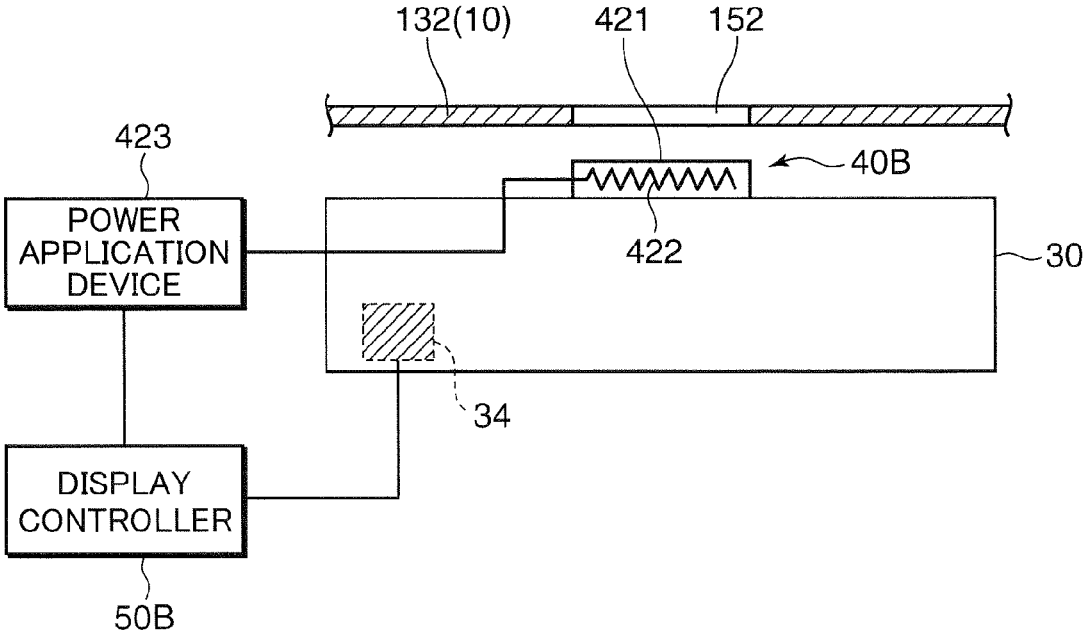
FIG. 14 is a diagram showing a second example of the toner remaining amount indicator.

FIG. 14 is a diagram showing a toner remaining amount indicator 40B according to a second embodiment. This toner remaining amount indicator 40B includes a sheet-like thermosensitive member 421 and a resistance heating member 422 for heating this thermosensitive member 421. A reversible or irreversible thermosensitive coloring member can be used as the thermosensitive member 422. For example, a thermosensitive paper, a thermosensitive resin, a plate printed with a thermosensitive discoloring ink or a plate having a rewrite layer using a thermosensitive material containing a reversible leuco dye can be used. The thermosensitive member 421 is opposed to the window 152.

The resistance heating member 422 generates Joule heat by having power applied from a power application device 423. The resistance heating member 422 is controllably driven by a display controller 50B. The display controller 50B controls a heated state of the resistance heating member 422 in accordance with the detection result on the toner remaining amount in the toner container 30 by the toner remaining amount detecting sensor 34. It should be noted that another heating member such as a light heating member may be used in place of the resistance heating member 422.

For example, the display controller 50B prevents the resistance heating member 422 from operating (generating heat) if the sufficient toner remaining amount is judged based on the detection result of the toner remaining amount detecting sensor 34. On the other hand, if the toner remaining amount is judged to be little, the display controller 50B controls the power application device 423 to cause the resistance heating member 422 to generate heat, thereby causing the resistance heating member 422 to discolor. Thus, the user can know the shortage of the toner in the toner container 30 by seeing the discoloration through the window 152.

Figure 15:
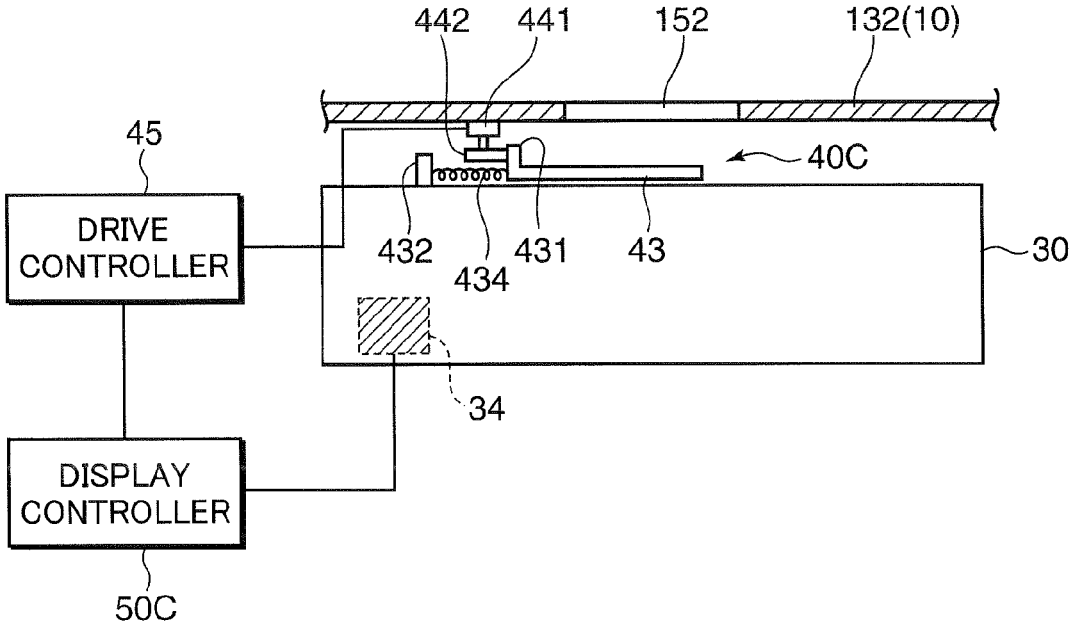
FIG. 15 is a diagram showing a third example of the toner remaining amount indicator.

FIG. 15 is a diagram showing a toner remaining amount indicator 40C according to a third example. This toner remaining amount indicator 40C includes an indicator plate 43 (moving member) slidably mounted on the upper surface of the toner container and a drive motor 441 (driving member) for sliding this indicator plate 43.

Figure 16:
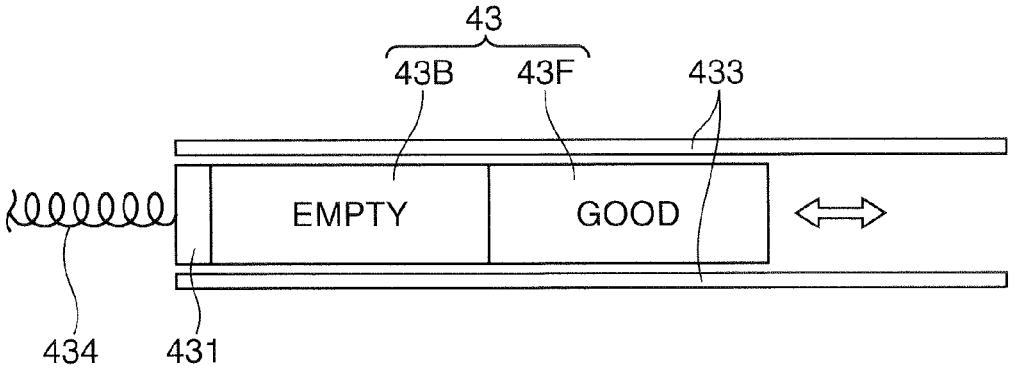
FIG. 16 is a top view of a indicator plate used in the third example.

As shown in FIG. 16, the indicator plate 43 has an indicator surface on the upper surface thereof, i.e. a surface facing the window 152. Here is shown an example in which characters "GOOD" indicating the sufficient toner remaining amount in the toner container 30 are displayed at a front side 43F of the indicator plate 43 in a moving direction, and characters "EMPTY" indicating the shortage of the toner are displayed at a back side 43B in the moving direction. The indicator plate 43 is moved along a pair of guide members 433 provided on the upper surface of the toner container 30.

The drive motor 441 is mounted on the underside of the opening cover 132, and a cam plate 442 is mounted on its motor shaft. The cam plate 442 is in contact with an interference plate 431 standing on the rear end edge of the indicator plate 43 in the moving direction. A biasing member 434 including a coil spring is provided between a base plate 432 standing at a specified position of the upper surface of the toner container 30 and the interference plate 431, whereby the indicator plate 43 is biased toward the back side in the moving direction.

The drive motor 441 has the rotation thereof controlled by a drive controller 45 and has the drive thereof controlled by a display controller 50C. The display controller 50C feeds a drive control signal for the drive motor 441 to the drive controller 45 in accordance with the detection result on the toner remaining amount in the toner container 30 by the toner remaining amount detecting sensor 34.

The cam plate 442 of the drive motor 441 is at a home position when a minor axis part thereof is in contact with the interference plate 431, and the front side 43F of the indicator plate 43 faces the window 152 at this time. The display controller 50C prevents the drive motor 44 from operating (rotating) upon judging that the toner remaining amount is sufficient based on the detection result of the toner remaining amount detecting sensor 43. As a result, characters "GOOD" are displayed in the window 152 and the user can known that sufficient toner remains in the toner container 30 just by seeing this display.

Figure 17:
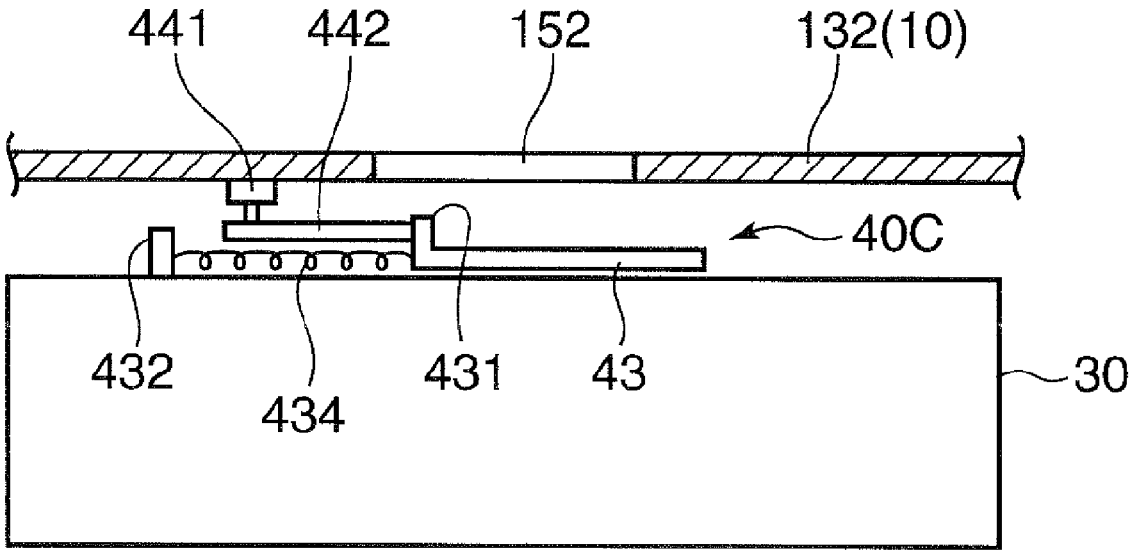
FIG. 17 is a diagram showing the operation of the toner remaining amount indicator of the third example.

On the other hand, the display controller 50C operates the drive motor 441 via the drive controller 45 to change into a state where a major axis part of the cam plate 442 is in contact with the interference plate 431 as shown in FIG. 17 when the toner remaining amount is judged to be little. At this time, the indicator plate 43 is pushed by the cam plate 442 against the biasing force of the biasing member 434 and the back side 43B comes to face the window 152. As a result, characters "EMPTY" are displayed in the window 152 and the user can know the shortage of toner in the toner particles container 30.

In the above construction, the slidable indicator plate 43 is merely an example and a rotary indicator plate may, for example, be used instead of this. Further, the drive motor 441 may be mounted on the upper surface of the toner container 30.

The printers 1, 1' according to the embodiments of the present invention are described above, but the present invention is not limited thereto. For example, the present invention may be embodied as follows.

[1] The printers 1, 1' are illustrated as examples of the image forming apparatus in the above embodiments. It goes without saying that the present invention is also applicable to copiers, facsimile machines, complex machines of these and other image forming apparatuses.

[2] In the above embodiments, one window 152 is arranged at the bottom surface of the window recess 151 formed on the opening cover 132. The window 152 may be provided somewhere other than at the discharge unit 13 (sheet receiving surface 130). For example, the window 152 may be provided on the front surface of the apparatus main body 10 (on the outer surface of the manual sheet feeder 12 in the above embodiments). Alternatively, the window 152 may be provided in flush with the outer casing of the apparatus main body 10. It is preferable to arrange an illumination device in the vicinity of the window 152 in order to improve the visibility of the window 152 even in a dark place.

A plurality of windows 152 may be provided. For example, in the case of providing one toner container 30 with a plurality of indicators 32 or in the case of mounting a plurality of toner containers 30 into the apparatus main body 10 of a color printer, a plurality of windows 152 are useful. Alternatively, substantially one window 152 may be an aggregate of a multitude of small windows. In this case, one window may be provided at the bottom surface of one recess or a plurality of windows may be provided at the bottom surface of one recess.

In the above embodiments, the window 152 is arranged in the widthwise center of the sheet receiving surface 130 with a view to utilizing the window 152 as a center indicator in the discharge unit 13. Instead, the window 152 may be arranged at a position deviated from the transverse center of the sheet receiving surface 130 or near an end of the sheet receiving surface 130. Alternatively, the window 152 may be in the form of a slit extending in the width direction of the sheet receiving surface 130.

[3] In the above embodiments, the auxiliary tray 16 is attached to the confirmation portion 15 including the window 152. However, the auxiliary tray 16 may be attached somewhere other than at the confirmation portion 15. Alternatively, the auxiliary tray 16 itself may be omitted. Further, instead of forming the opening in the auxiliary tray 16, a transparent triangular plate may be used as the auxiliary tray 16.

[4] In the above embodiments, the indicator 32 of the toner container 30 is triangular and printed with characters and dingbats as indication information. The shape of the indicator 32 is arbitrary and may be one of various shapes having directivities other than triangular shapes or one of various shapes having no directivity. Further, the shape of the window 152 and that of the indicator 32 of the toner container 30 may not necessarily conform to each other.

The indication information preferably includes at least one of characters, a symbol and a dingbat, but may be mere color information or the like. In order to improve the visibility of the indicator 32 in a dark plate, the indicator 32 may be made of a fluorescent or light storing material or may be formed by a luminescent or thermosensitive panel or the like.

[5] In the above embodiments, the engaging structure of the indicator recess 33 and the window recess 151 is illustrated as the light shielding structure. Instead, the light shielding structure may, for example, be such that the window recess 151 is surrounded by a spongy lightproof sealing member having a light shielding property on the underside of the opening cover 132 and the projecting end of the lightproof sealing member is held in contact with or in proximity to the upper surface of the toner container 30.

[6] In the above embodiments, the electrophotographic printer 1 and the toner container 30 to be mounted therein are illustrated as examples of the image forming apparatus and the consumable supplying member. Besides, the present invention is also applicable, for example, to ink-jet printers and ink cartridges mounted therein. Further, the present invention is widely applicable to various household apparatuses, various industrial electric/mechanical apparatuses and the like and consumable supplying members mounted therein.

[7] In the above embodiments, the indicator 32 or the toner remaining amount indicators 40A to 40C provided on the outer surface of the toner container 30 are illustrated as the "indicator". Instead, an indicator for displaying specified indicator information may be provided at another part in the apparatus main body 10.

The specific embodiments described above mainly embrace inventions having the following constructions.

An image forming apparatus according to one aspect of the present invention comprises an apparatus main body having a casing structure and adapted to perform an image forming operation; a window provided on a casing of the apparatus main body for enabling the interior of the apparatus main body to be seen; and an indicator provided in the apparatus main body for displaying specified indication information, the indicator being arranged at such a position as to face the window.

According to this construction, a user can confirm the indication information of the indicator through the window provided in the apparatus main body. Thus, the user can grasp the indication information on the interior of the apparatus main body without opening an opening cover or the like.

In the above construction, it is preferable that a consumable supplying member to be detachably mounted in the apparatus main body is further provided; that the window enables a part of the consumable supplying member to be seen with the consumable supplying member mounted in the apparatus main body; and that the indicator is provided on the outer surface of the consumable supplying member at such a position as to face the window with the consumable supplying member mounted in the apparatus main body.

According to this construction, the user can confirm the indication information of the indicator provided on the outer surface of the consumable supplying member through the window provided on the apparatus main body. Thus, the user can know which consumable supplying member is actually mounted in the apparatus main body without opening the opening cover or the like.

In the above construction, it is preferable that the window has a specified shape having a directivity; and that the indicator has substantially the same shape as that of the window.

According to this construction, since the window and the indicator have directivities, the user can easily notice an erroneous mounting based on a difference between the directivities of the window and the indicator in the case of inadvertently attempting to mount the consumable supplying member into the apparatus main body in a wrong direction.

In this case, the window more preferably has a symmetrical shape with an apex faced in an installation direction of the consumable supplying member into the apparatus main body.

According to this construction, the user can install the consumable supplying member into the apparatus main body by being navigated by the facing direction of the apex of the window and, therefore, it can be prevented to mount the consumable supplying member in a wrong direction. Further, since the window has the symmetric shape having the apex faced in the installation direction, design can be improved.

In the above construction, it is preferable that the indicator includes at least one of a character, a symbol and a dingbat as indication information; and that the indication information is oriented in a correct direction when viewed in a reference direction, which is a specified direction toward the apparatus main body, if the consumable supplying member is normally mounted into the apparatus main body.

According to this construction, the user can read character information or the like on the indicator from the reference direction, i.e. from the correct direction, if the consumable supplying member is normally mounted in the apparatus main body. Thus, the user can easily see or read the indication information and, if the consumable supplying member is mounted in a wrong direction, such an error can be quickly noticed since the character information or the like is inverted.

In the above construction, it is one of preferable embodiments that the apparatus main body includes a developing mechanism inside; and that the consumable supplying member is a toner container for supplying toner particles to the developing mechanism.

According to this construction, the user can know which toner container is actually mounted in the apparatus main body without opening the opening cover or the like.

In the above construction, a consumable supplying member to be detachably mounted into the apparatus main body may be further provided, and the indicator may be a remaining amount indicator for displaying specified indication information on the remaining amount of the consumable.

According to this construction, the user can easily grasp the remaining amount of the consumable through the window since the remaining amount indicator visible through the window is provided.

In this case, it is preferable that a developing mechanism is provided in the apparatus main body; that the consumable supplying member is a toner container for supplying toner particles to the developing mechanism; and that the remaining amount indicator is provided on the toner container at such a position as to face the window with the toner container mounted in the apparatus main body.

According to this construction, the user can grasp the remaining amount of toner particles in the toner container through the window without opening the opening cover or the like.

In this construction, it is preferable to further comprise a toner remaining amount detector for detecting a toner remaining amount in the toner container and an indicator controller for changing an indication mode of the remaining amount indicator according to the toner remaining amount.

According to this construction, the indication mode of the remaining amount indicator is changed by the indicator controller according to the toner remaining amount detected by the toner remaining amount detector. Thus, the remaining amount can be precisely displayed based on the actual toner remaining amount in the toner container.

In the above construction, it is preferable to further comprise a light shielding portion provided in the vicinity of the window in the casing of the apparatus main body for preventing the diffusion of incident light through the window into the interior of the casing.

According to this construction, even if light is incident through the window, it is prevented from diffusing into the interior of the casing since the light shielding portion is provided in the vicinity of the window. Accordingly, the adverse effect of external light on the image forming operation can be prevented and parts present in the apparatus main body and desired not to be exposed to light can also be protected.

In this case, it is preferable that a consumable supplying member to be detachably mounted in the apparatus main body is further provided; that the window enables a part of the consumable supplying member to be seen with the consumable supplying member mounted in the apparatus main body; that the indicator is provided on the outer surface of the consumable supplying member at such a position as to face the window with the consumable supplying member mounted in the apparatus main body; and that the light shielding portion includes a light shielding wall standing on the outer surface of the consumable supplying member in such a manner as to surround the indicator of the consumable supplying member.

According to this construction, since the light shielding wall is provided to surround the indicator of the consumable supplying member, light incident through the window is reflected by this light shielding wall, with the result that the light does not diffuse into the interior of the casing. Toner particles may fly in the interior of the apparatus main body, but the flying toner particles are more unlikely to reach the window by the presence of the light shielding wall, which gives an advantage of suppressing the smearing of the inner surface of the window.

It is preferable that the window is provided at the bottom surface of a recess formed by recessing a part of the casing; and that the light shielding wall defines an accommodation space for accommodating the recess projecting inward of the casing.

According to this construction, since the window is provided at the bottom surface of the recess, it can be suppressed that the window interferes with other objects to be scratched or smeared. Further, since the light shielding wall serves to accommodate the recess, the window is surrounded by the light shielding wall while the window is held close to the indicator of the consumable supplying member. Therefore, light shielding efficiency can be further improved.

It is preferable that the recess including the window has a specified shape having a directivity; and that the light shielding wall defining the accommodation space is shaped in conformity with the recess.

According to this construction, since the shape of the recess including the window and that of the accommodation space defined by the light shielding wall have similar directivities, the recess cannot be fitted into the accommodation space if the user inadvertently attempts to mount the consumable supplying member into the apparatus main body in a wrong direction, and the user can easily notice such an erroneous mounting.

In the above construction, the window is preferably provided at the bottom surface of a recess formed by recessing a part of the casing.

According to this construction, the window is not provided in flush with the casing, but at the bottom surface of the recess formed by recessing the part of the casing. Thus, it can be prevented that the window easily interferes with other objects and it can be suppressed that the window is easily scratched or smeared. Therefore, good visibility of the window can be maintained.

In this case, it is preferable that a discharge unit for receiving a sheet discharged after an image forming operation is performed in the apparatus main body is provided on the upper surface of the casing of the apparatus main body; and that the window is provided on the discharge unit.

According to this construction, the window is provided on the discharge unit on the upper surface of the casing, which is easy for the user to see. Thus, even if the window is provided at the bottom surface of the recess of the casing, good visibility can be ensured.

It is preferable to arrange the window at a front side of the discharge unit in a conveying direction of a sheet discharged to the discharge unit.

According to this construction, since the recess including the window is present at the front side of the discharge unit in the sheet conveying direction, a recess is present at a position where the user grabs a sheet upon removing the sheet discharged to the discharge unit. Therefore, there is an advantage of making it easier for the user to grab an end of the sheet discharged to the discharge unit.

In the above construction, the window preferably doubles as a center indicator indicating a widthwise center position of a sheet discharged to the discharge unit.

According to this construction, the user can recognize the widthwise center position of a sheet (sheet stack) using the window as a marker. Thus, the user can remove the sheet in a well-balanced manner by grabbing the recognized widthwise center position of the sheet.

In this case, the window preferably has a symmetric shape with an apex faced toward the back side of a sheet receiving surface of the discharge unit in a sheet conveying direction and arranged at the widthwise center position of a sheet to be discharged to the discharge unit.

According to this construction, the widthwise center position of a sheet stack can be indicated by a simple and comprehensive shape. Further, since the center indicator has the symmetric shape with the apex faced toward the back side of the sheet receiving surface in the sheet conveying direction, design can be improved.

An consumable supplying member receiving apparatus according to another aspect of the present invention comprises an apparatus main body having a casing structure; a consumable supplying member to be detachably mounted in the apparatus main body; a window provided on a casing of the apparatus main body for enabling a part of the consumable supplying member to be seen with the consumable supplying member mounted in the apparatus main body; and an indicator provided on the apparatus main body for displaying specified indication information, the indicator being arranged at such a position as to face the window with the consumable supplying member mounted in the apparatus main body.

According to this construction, a user can know which consumable supplying member is actually mounted in the apparatus main body from the outside of the consumable supplying member receiving apparatus. Thus, for example, at the time of ordering a toner container or requesting maintenance, the necessary model number of the toner container or the like can be quickly grasped, whereby user convenience can be improved.

An consumable supplying member receiving apparatus according to still another aspect of the present invention comprises an apparatus main body having a casing structure; a consumable supplying member to be detachably mounted in the apparatus main body; a window provided on the apparatus main body for enabling a part of the consumable supplying member to be seen with the consumable supplying member mounted in the apparatus main body; and a light shielding portion provided in the vicinity of the window in the interior of the casing of the apparatus main body for preventing light incident through the window from diffusing into the interior of the casing.

According to this construction, since the light shielding portion is provided in the vicinity of the widow, even if light is incident through the window, it is prevented from diffusing into the interior of the casing and parts present in the receiving apparatus and desired not to be exposed to light can be protected.

This application is based on patent application Nos. 2007-002457, 2007-002458, 2007-002459, 2007-002460 and 2007-002462 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

an apparatus main body having a casing structure and adapted to perform an image forming operation;

a consumable supplying member to be detachably mounted in the apparatus main body;

a window provided on a casing of the apparatus main body for enabling the interior of the apparatus main body to be seen, the window enables a part of the consumable supplying member to be seen with the consumable supplying member mounted in the apparatus main body; and an indicator provided in the apparatus main body for displaying specified indication information, the indicator being arranged at such a position as to face the window, the indicator is provided on the outer surface of the consumable supplying member at such a position as to face the window with the consumable supplying member mounted in the apparatus main body.

2. An image forming apparatus according to claim 1, wherein:

the window has a specified shape having a directivity; and the indicator has substantially the same shape as that of the window.

3. An image forming apparatus according to claim 1, wherein the window has a symmetrical shape with an apex faced in an installation direction of the consumable supplying member in the apparatus main body.

4. An image forming apparatus according to claim 1, wherein:

the indicator includes at least one of a character, a symbol and a dingbat as indication information; and the indication information is oriented in a correct direction when viewed in a reference direction, which is a specified direction toward the apparatus main body, if the consumable supplying member is normally mounted into the apparatus main body.

5. An image forming apparatus according to claim 1, further comprising a developing mechanism provided inside the apparatus main body, wherein the consumable supplying member is a toner container for supplying toner particles to the developing mechanism.

6. An image forming apparatus according to claim 1, further comprising a consumable supplying member to be detachably mounted into the apparatus main body, wherein the indicator is a remaining amount indicator for displaying specified indication information on the remaining amount of the consumable.

7. An image forming apparatus according to claim 6, further comprising a developing mechanism provided in the apparatus main body, wherein:

the consumable supplying member is a toner container for supplying toner particles to the developing mechanism; and the remaining amount indicator is provided on the toner container at such a position as to face the window with the toner container mounted in the apparatus main body.

8. An image forming apparatus according to claim 7, further comprising:

a toner remaining amount detector for detecting a toner remaining amount in the toner container; and an indicator controller for changing an indication mode of the remaining amount indicator according to the toner remaining amount.

9. An image forming apparatus comprising:

an apparatus main body having a casing structure and adapted to perform an image forming operation;

a window provided on a casing of the apparatus main body for enabling the interior of the apparatus main body to be seen;

a light shielding portion provided in the vicinity of the window in the casing of the apparatus main body for preventing the diffusion of incident light through the window into the interior of the casing; and an indicator provided in the apparatus main body for displaying specified indication information, the indicator being arranged at such a position as to face the window.

10. An image forming apparatus according to claim 9, further comprising a consumable supplying member to be detachably mounted in the apparatus main body, wherein:

the window enables a part of the consumable supplying member to be seen with the consumable supplying member mounted in the apparatus main body;

the indicator is provided on the outer surface of the consumable supplying member at such a position as to face the window with the consumable supplying member mounted in the apparatus main body; and the light shielding portion includes a light shielding wall standing on the outer surface of the consumable supplying member in such a manner as to surround the indicator of the consumable supplying member.

11. An image forming apparatus according to claim 10, wherein:

the window is provided at the bottom surface of a recess formed by recessing a part of the casing; and the light shielding wall defines an accommodation space for accommodating the recess projecting inward of the casing.

12. An image forming apparatus according to claim 11, wherein:

the recess including the window has a specified shape having a directivity; and the light shielding wall defining the accommodation space is shaped in conformity with the recess.

13. An image forming apparatus, comprising:

an apparatus main body having a casing structure and adapted to perform an image forming operation;

a window provided on a casing of the apparatus main body for enabling the interior of the apparatus main body to be seen, wherein the window is provided at the bottom surface of a recess formed by recessing a part of the casing; and an indicator provided in the apparatus main body for displaying specified indication information, the indicator being arranged at such a position as to face the window.

14. An image forming apparatus according to claim 13, further comprising a discharge unit provided on the upper surface of the casing of the apparatus main body for receiving a sheet discharged after an image forming operation is performed in the apparatus main body, wherein the window is provided on the discharge unit.

15. An image forming apparatus according to claim 14, wherein the window is arranged at a front side of the discharge unit in a conveying direction of a sheet to be discharged to the discharge unit.

16. An image forming apparatus according to claim 15, wherein the window doubles as a center indicator indicating a widthwise center position of a sheet discharged to the discharge unit.

17. An image forming apparatus according to claim 16, wherein:

the window has a symmetric shape with an apex faced toward the back side of a sheet receiving surface of the discharge unit in a sheet conveying direction and arranged at the widthwise center position of a sheet to be discharged to the discharge unit.

18. An consumable supplying member receiving apparatus, comprising:

an apparatus main body having a casing structure;

a consumable supplying member to be detachably mounted in the apparatus main body;

a window provided on a casing of the apparatus main body for enabling a part of the consumable supplying member to be seen with the consumable supplying member mounted in the apparatus main body; and an indicator provided on the apparatus main body for displaying specified indication information, the indicator being arranged at such a position as to face the window with the consumable supplying member mounted in the apparatus main body.

19. An consumable supplying member receiving apparatus, comprising:

an apparatus main body having a casing structure;

a consumable supplying member to be detachably mounted in the apparatus main body;

a window provided on the apparatus main body for enabling a part of the consumable supplying member to be seen with the consumable supplying member mounted in the apparatus main body; and a light shielding portion provided in the vicinity of the window in the interior of the casing of the apparatus main body for preventing light incident through the window from diffusing into the interior of the casing.

20. An image forming apparatus, comprising:

an apparatus main body having a casing structure and adapted to perform an image forming operation;

a sheet receiving surface constituting a part of an upper surface of the casing structure and adapted to receive a sheet to be discharged after the image forming operation is performed in the apparatus main body;

a window on the sheet receiving surface and enabling an interior of the apparatus main body to be seen; and an indicator provided in the apparatus main body at a position facing the window, the indicator being operative to display specified indication information.

21. The image forming apparatus according to claim 20, further comprising:

a consumable supplying member to be detachably mounted in the apparatus main body, the window being disposed to enable a part of the consumable supplying member to be seen when the consumable supplying member is mounted in the apparatus main body, and the indicator being provided on an outer surface of the consumable supplying member at a position facing the window when the consumable supplying member is mounted in the apparatus main body.

22. The image forming apparatus according to claim 21, wherein:

a part of the sheet receiving surface defines an opening cover and is configured to be opened and closed when the consumable supplying member is detachably mounted in the apparatus main body, and the window is provided at the opening cover.

23. The image forming apparatus according to claim 22, wherein:

the opening cover has a first end edge and a second end edge opposite the first end edge, and a first rotary shaft is provided on a portion of the opening cover at the first end edge of the opening cover, and the opening cover is opened rotatably about the first rotary shaft by operating the second end edge.

24. The image forming apparatus according to claim 23, further comprising a discharge port provided on the apparatus main body, and adapted to discharge a sheet on the sheet receiving surface, wherein the first end edge and the second end edge each extending in a direction perpendicular to a conveying direction of a sheet to be discharged through the discharge port, and the first end edge is formed at a portion close to the discharge port.

25. The image forming apparatus according to claim 24, wherein:

the apparatus main body has an accommodation space and the consumable supplying member being detachably mounted in the accommodation space of the apparatus main body, the accommodation space being upwardly opened by upwardly lifting the second end edge of the opening cover.

26. The image forming apparatus according to claim 24, wherein:

the window has a symmetric shape with an apex faced toward a back side of the sheet receiving surface in the sheet conveying direction, and the apex is arranged at a widthwise center position of a sheet to be discharged to the sheet receiving surface.

27. The image forming apparatus according to claim 20, wherein:

the window is disposed and configured to define a center indicator indicating a widthwise center position of a sheet to be discharged to the sheet receiving surface.

* * * * *